US008847833B2

(12) United States Patent
Korva et al.

(10) Patent No.: US 8,847,833 B2
(45) Date of Patent: Sep. 30, 2014

(54) LOOP RESONATOR APPARATUS AND METHODS FOR ENHANCED FIELD CONTROL

(75) Inventors: Heikki Korva, Tupos (FI); Petteri Annamaa, Oulunsalo (FI)

(73) Assignee: Pulse Finland Oy, Kempele (FI)

( * ) Notice: Subject to any disclaimer, the term of this patent is extended or adjusted under 35 U.S.C. 154(b) by 1081 days.

(21) Appl. No.: 12/649,231

(22) Filed: Dec. 29, 2009

(65) Prior Publication Data

US 2011/0156972 A1 Jun. 30, 2011

(51) Int. Cl.
*H01Q 9/00* (2006.01)

(52) U.S. Cl.
USPC ..... 343/745

(58) Field of Classification Search
USPC ..... 343/745
See application file for complete search history.

(56) References Cited

U.S. PATENT DOCUMENTS

| | | | |
|---|---|---|---|
| 2,745,102 | A | 5/1956 | Norgorden |
| 3,938,161 | A | 2/1976 | Sanford |
| 4,004,228 | A | 1/1977 | Mullett |
| 4,028,652 | A | 6/1977 | Wakino et al. |
| 4,031,468 | A | 6/1977 | Ziebell et al. |
| 4,054,874 | A | 10/1977 | Oltman |
| 4,069,483 | A | 1/1978 | Kaloi |
| 4,123,756 | A | 10/1978 | Nagata et al. |
| 4,123,758 | A | 10/1978 | Shibano et al. |
| 4,131,893 | A | 12/1978 | Munson et al. |
| 4,201,960 | A | 5/1980 | Skutta et al. |
| 4,255,729 | A | 3/1981 | Fukasawa et al. |
| 4,313,121 | A | 1/1982 | Campbell et al. |
| 4,356,492 | A | 10/1982 | Kaloi |
| 4,370,657 | A | 1/1983 | Kaloi |
| 4,423,396 | A | 12/1983 | Makimoto et al. |
| 4,431,977 | A | 2/1984 | Sokola et al. |
| 4,546,357 | A | 10/1985 | Laughon et al. |
| 4,559,508 | A | 12/1985 | Nishikawa et al. |
| 4,625,212 | A | 11/1986 | Oda et al. |

(Continued)

FOREIGN PATENT DOCUMENTS

| | | |
|---|---|---|
| CN | 1316797 | 10/2007 |
| DE | 10015583 | 11/2000 |

(Continued)

OTHER PUBLICATIONS

"An Adaptive Microstrip Patch Antenna for Use in Portable Transceivers", Rostbakken et al., Vehicular Technology Conference, 1996, Mobile Technology for the Human Race, pp. 339-343.

(Continued)

*Primary Examiner* — Robert Karacsony
(74) *Attorney, Agent, or Firm* — Gazdzinski & Associates, PC

(57) ABSTRACT

A radiating antenna element intended for portable radio devices and methods for designing manufacturing the same. In one embodiment, a loop resonator structure for enhanced field (e.g., electric field) is provided, the resonator having an inductive and a capacitive element forming a resonance in a first frequency band. The loop resonator structure is disposed substantially on the ground plane, thereby altering electrical energy distribution. The location of the resonant element is selected to reduce electric field strength proximate to one or more sensitive components, such as a mobile device earpiece, thereby improve hearing aid compliance. Capacitive tuning of the resonator, and the use of multiple resonator structures on the same device, are further described.

6 Claims, 24 Drawing Sheets

(56) References Cited

U.S. PATENT DOCUMENTS 4,653,889 A 3/1987 Bizouard et al.
4,661,992 A 4/1987 Garay et al.
4,692,726 A 9/1987 Green et al.
4,703,291 A 10/1987 Nishikawa et al.
4,706,050 A 11/1987 Andrews
4,716,391 A 12/1987 Moutrie et al.
4,740,765 A 4/1988 Ishikawa et al.
4,742,562 A 5/1988 Kommrusch
4,761,624 A 8/1988 Igarashi et al.
4,800,348 A 1/1989 Rosar et al.
4,800,392 A 1/1989 Garay et al.
4,821,006 A 4/1989 Ishikawa et al.
4,823,098 A 4/1989 DeMuro et al.
4,827,266 A 5/1989 Sato et al.
4,829,274 A 5/1989 Green et al.
4,862,181 A 8/1989 PonceDeLeon et al.
4,879,533 A 11/1989 De Muro et al.
4,896,124 A 1/1990 Schwent
4,954,796 A 9/1990 Green et al.
4,965,537 A 10/1990 Kommrusch
4,977,383 A 12/1990 Niiranen
4,980,694 A 12/1990 Hines
5,017,932 A 5/1991 Ushiyama et al.
5,047,739 A 9/1991 Kuokkanene
5,053,786 A 10/1991 Silverman et al.
5,097,236 A 3/1992 Wakino et al.
5,103,197 A 4/1992 Turunen
5,109,536 A 4/1992 Kommrusch
5,155,493 A 10/1992 Thursby et al.
5,157,363 A 10/1992 Puurunen
5,159,303 A 10/1992 Flink
5,166,697 A 11/1992 Viladevall et al.
5,170,173 A 12/1992 Krenz et al.
5,203,021 A 4/1993 Repplinger et al.
5,210,510 A 5/1993 Karsikas
5,210,542 A 5/1993 Pett et al.
5,220,335 A 6/1993 Huang
5,229,777 A 7/1993 Doyle
5,239,279 A 8/1993 Turunen
5,278,528 A 1/1994 Turunen
5,281,326 A 1/1994 Galla
5,298,873 A 3/1994 Ala-Kojola
5,302,924 A 4/1994 Jantunen
5,304,968 A 4/1994 Ohtonen
5,307,036 A 4/1994 Turunen
5,319,328 A 6/1994 Turunen
5,349,315 A 9/1994 Ala-Kojola
5,349,700 A 9/1994 Parker
5,351,023 A 9/1994 Niiranen
5,354,463 A 10/1994 Turunen
5,355,142 A 10/1994 Marshall et al.
5,357,262 A 10/1994 Blaese
5,363,114 A 11/1994 Shoemaker
5,369,782 A 11/1994 Kawano et al.
5,382,959 A 1/1995 Pett et al.
5,386,214 A 1/1995 Sugawara
5,387,886 A 2/1995 Takalo
5,394,162 A 2/1995 Korovesis et al.
RE34,898 E 4/1995 Turunen
5,408,206 A 4/1995 Turunen
5,418,508 A 5/1995 Puurunen
5,432,489 A 7/1995 Yrjola
5,438,697 A 8/1995 Fowler et al.
5,440,315 A 8/1995 Wright et al.
5,442,366 A 8/1995 Sanford
5,444,453 A 8/1995 Lalezari
5,467,065 A 11/1995 Turunen
5,473,295 A 12/1995 Turunen
5,506,554 A 4/1996 Ala-Kojola
5,508,668 A 4/1996 Prokkola
5,517,683 A 5/1996 Collett et al.
5,521,561 A 5/1996 Yrjola
5,532,703 A 7/1996 Stephens et al.
5,541,560 A 7/1996 Turunen
5,541,617 A 7/1996 Connolly et al.
5,543,764 A 8/1996 Turunen
5,550,519 A 8/1996 Korpela
5,557,287 A 9/1996 Pottala et al.
5,557,292 A 9/1996 Nygren et al.
5,570,071 A 10/1996 Ervasti
5,585,771 A 12/1996 Ervasti
5,585,810 A 12/1996 Tsuru et al.
5,589,844 A 12/1996 Belcher et al.
5,594,395 A 1/1997 Niiranen
5,604,471 A 2/1997 Rattila
5,627,502 A 5/1997 Ervasti
5,649,316 A 7/1997 Prudhomme et al.
5,668,561 A 9/1997 Perrotta et al.
5,675,301 A 10/1997 Nappa
5,689,221 A 11/1997 Niiranen
5,694,135 A 12/1997 Dikun et al.
5,703,600 A 12/1997 Burrell et al.
5,709,823 A 1/1998 Hayes et al.
5,711,014 A 1/1998 Crowley et al.
5,717,368 A 2/1998 Niiranen
5,731,749 A 3/1998 Yrjola
5,734,305 A 3/1998 Ervasti
5,734,350 A 3/1998 Deming et al.
5,734,351 A 3/1998 Ojantakanen
5,739,735 A 4/1998 Pyykko
5,742,259 A 4/1998 Annamaa
5,757,327 A 5/1998 Yajima et al.
5,764,190 A 6/1998 Murch et al.
5,767,809 A 6/1998 Chuang et al.
5,768,217 A 6/1998 Sonoda et al.
5,777,581 A 7/1998 Lilly et al.
5,777,585 A 7/1998 Tsuda et al.
5,793,269 A 8/1998 Ervasti
5,812,094 A 9/1998 Maldonado
5,815,048 A 9/1998 Ala-Kojola
5,822,705 A 10/1998 Lehtola
5,852,421 A 12/1998 Maldonado
5,861,854 A 1/1999 Kawahata et al.
5,874,926 A 2/1999 Tsuru et al.
5,880,697 A 3/1999 McCarrick et al.
5,886,668 A 3/1999 Pedersen et al.
5,892,490 A 4/1999 Asakura et al.
5,903,820 A 5/1999 Hagstrom
5,905,475 A 5/1999 Annamaa
5,920,290 A 7/1999 McDonough et al.
5,926,139 A 7/1999 Korisch
5,929,813 A 7/1999 Eggleston
5,936,583 A 8/1999 Tadahiko et al.
5,943,016 A 8/1999 Snyder, Jr. et al.
5,952,975 A 9/1999 Pedersen et al.
5,959,583 A 9/1999 Funk
5,963,180 A 10/1999 Leisten
5,966,097 A 10/1999 Fukasawa et al.
5,970,393 A 10/1999 Khorrami et al.
5,977,710 A 11/1999 Kuramoto et al.
5,986,606 A 11/1999 Kossiavas et al.
5,986,608 A 11/1999 Korisch et al.
5,990,848 A 11/1999 Annamaa
5,999,132 A 12/1999 Kitchener et al.
6,005,529 A 12/1999 Hutchinson
6,006,419 A 12/1999 Vandendolder et al.
6,008,764 A 12/1999 Ollikainen
6,009,311 A 12/1999 Killion et al.
6,014,106 A 1/2000 Annamaa
6,016,130 A 1/2000 Annamaa
6,023,608 A 2/2000 Yrjola
6,031,496 A 2/2000 Kuittinen et al.
6,034,637 A 3/2000 McCoy et al.
6,037,848 A 3/2000 Alila
6,043,780 A 3/2000 Funk et al.
6,072,434 A 6/2000 Papatheodorou
6,078,231 A 6/2000 Pelkonen
6,091,363 A 7/2000 Komatsu et al.
6,097,345 A 8/2000 Walton
6,100,849 A 8/2000 Tsubaki et al.
6,112,108 A 8/2000 Crowley et al.
6,133,879 A 10/2000 Grangeat et al.
6,134,421 A 10/2000 Lee et al.
6,140,973 A 10/2000 Annamaa

(56) References Cited

U.S. PATENT DOCUMENTS

| | | | |
|---|---|---|---|
| 6,147,650 | A | 11/2000 | Kawahata et al. |
| 6,157,819 | A | 12/2000 | Vuokko |
| 6,177,908 | B1 | 1/2001 | Kawahata |
| 6,185,434 | B1 | 2/2001 | Hagstrom |
| 6,190,942 | B1 | 2/2001 | Wilm et al. |
| 6,195,049 | B1 | 2/2001 | Kim et al. |
| 6,204,826 | B1 | 3/2001 | Rutkowski et al. |
| 6,215,376 | B1 | 4/2001 | Hagstrom |
| 6,246,368 | B1 | 6/2001 | Deming et al. |
| 6,252,552 | B1 | 6/2001 | Tarvas et al. |
| 6,252,564 | B1 | 6/2001 | Isohatala et al. |
| 6,255,994 | B1 | 7/2001 | Saito |
| 6,268,831 | B1 | 7/2001 | Sanford |
| 6,295,029 | B1 | 9/2001 | Chen et al. |
| 6,297,776 | B1 | 10/2001 | Pankinaho |
| 6,304,220 | B1 | 10/2001 | Herve et al. |
| 6,308,720 | B1 | 10/2001 | Modi |
| 6,316,975 | B1 | 11/2001 | O'Toole et al. |
| 6,323,811 | B1 | 11/2001 | Tsubaki |
| 6,326,921 | B1 | 12/2001 | Egorov et al. |
| 6,337,663 | B1 | 1/2002 | Chi-Minh |
| 6,340,954 | B1 | 1/2002 | Annamaa et al. |
| 6,342,859 | B1 | 1/2002 | Kurz et al. |
| 6,346,914 | B1 | 2/2002 | Annamaa |
| 6,348,892 | B1 | 2/2002 | Annamaa |
| 6,353,443 | B1 | 3/2002 | Ying |
| 6,366,243 | B1 | 4/2002 | Isohatala |
| 6,377,827 | B1 | 4/2002 | Rydbeck |
| 6,380,905 | B1 | 4/2002 | Annamaa |
| 6,396,444 | B1 | 5/2002 | Goward |
| 6,404,394 | B1 | 6/2002 | Hill |
| 6,417,813 | B1 | 7/2002 | Durham |
| 6,423,915 | B1 | 7/2002 | Winter |
| 6,429,818 | B1 | 8/2002 | Johnson et al. |
| 6,452,551 | B1 | 9/2002 | Chen |
| 6,452,558 | B1 | 9/2002 | Saitou et al. |
| 6,456,249 | B1 | 9/2002 | Johnson et al. |
| 6,459,413 | B1 | 10/2002 | Tseng et al. |
| 6,462,716 | B1 | 10/2002 | Kushihi |
| 6,469,673 | B2 | 10/2002 | Kaiponen |
| 6,473,056 | B2 | 10/2002 | Annamaa |
| 6,476,769 | B1 | 11/2002 | Lehtola |
| 6,480,155 | B1 | 11/2002 | Eggleston |
| 6,501,425 | B1 | 12/2002 | Nagumo |
| 6,518,925 | B1 | 2/2003 | Annamaa |
| 6,529,168 | B2 | 3/2003 | Mikkola |
| 6,535,170 | B2 | 3/2003 | Sawamura et al. |
| 6,538,604 | B1 | 3/2003 | Isohatala |
| 6,549,167 | B1 | 4/2003 | Yoon |
| 6,556,812 | B1 | 4/2003 | Pennanen et al. |
| 6,566,944 | B1 | 5/2003 | Pehlke |
| 6,580,396 | B2 | 6/2003 | Lin |
| 6,580,397 | B2 | 6/2003 | Kuriyama et al. |
| 6,600,449 | B2 | 7/2003 | Onaka |
| 6,603,430 | B1 | 8/2003 | Hill et al. |
| 6,606,016 | B2 | 8/2003 | Takamine et al. |
| 6,611,235 | B2 | 8/2003 | Barna et al. |
| 6,614,400 | B2 | 9/2003 | Egorov |
| 6,614,405 | B1 | 9/2003 | Mikkonen |
| 6,634,564 | B2 | 10/2003 | Kuramochi |
| 6,636,181 | B2 | 10/2003 | Asano |
| 6,639,564 | B2 | 10/2003 | Johnson |
| 6,646,606 | B2 | 11/2003 | Mikkola |
| 6,650,295 | B2 | 11/2003 | Ollikainen et al. |
| 6,657,593 | B2 | 12/2003 | Nagumo et al. |
| 6,657,595 | B1 | 12/2003 | Phillips et al. |
| 6,670,926 | B2 | 12/2003 | Miyasaka |
| 6,677,903 | B2 | 1/2004 | Wang |
| 6,683,573 | B2 | 1/2004 | Park |
| 6,693,594 | B2 | 2/2004 | Pankinaho et al. |
| 6,717,551 | B1 | 4/2004 | Desclos et al. |
| 6,727,857 | B2 | 4/2004 | Mikkola |
| 6,734,825 | B1 | 5/2004 | Guo et al. |
| 6,734,826 | B1 | 5/2004 | Dai et al. |
| 6,738,022 | B2 | 5/2004 | Klaavo et al. |
| 6,741,214 | B1 | 5/2004 | Kadambi et al. |
| 6,753,813 | B2 | 6/2004 | Kushihi |
| 6,759,989 | B2 | 7/2004 | Tarvas et al. |
| 6,765,536 | B2 | 7/2004 | Phillips et al. |
| 6,774,853 | B2 | 8/2004 | Wong et al. |
| 6,781,545 | B2 | 8/2004 | Sung |
| 6,801,166 | B2 | 10/2004 | Mikkola |
| 6,801,169 | B1 | 10/2004 | Chang et al. |
| 6,806,835 | B2 | 10/2004 | Iwai |
| 6,819,287 | B2 | 11/2004 | Sullivan et al. |
| 6,819,293 | B2 | 11/2004 | Johannes et al. |
| 6,825,818 | B2 | 11/2004 | Toncich |
| 6,836,249 | B2 | 12/2004 | Kenoun et al. |
| 6,847,329 | B2 | 1/2005 | Ikegaya et al. |
| 6,856,293 | B2 | 2/2005 | Bordi |
| 6,862,437 | B1 | 3/2005 | McNamara |
| 6,862,441 | B2 | 3/2005 | Ella |
| 6,873,291 | B2 | 3/2005 | Aoyama |
| 6,876,329 | B2 | 4/2005 | Milosavljevic |
| 6,882,317 | B2 | 4/2005 | Koskiniemi |
| 6,891,507 | B2 | 5/2005 | Kushihi et al. |
| 6,897,810 | B2 | 5/2005 | Dai et al. |
| 6,900,768 | B2 | 5/2005 | Iguchi et al. |
| 6,903,692 | B2 | 6/2005 | Kivekas |
| 6,911,945 | B2 | 6/2005 | Korva |
| 6,922,171 | B2 | 7/2005 | Annamaa |
| 6,925,689 | B2 | 8/2005 | Folkmar |
| 6,927,792 | B1 | 8/2005 | Legay |
| 6,937,196 | B2 | 8/2005 | Korva |
| 6,950,066 | B2 | 9/2005 | Hendler et al. |
| 6,950,068 | B2 | 9/2005 | Bordi |
| 6,952,144 | B2 | 10/2005 | Javor |
| 6,952,187 | B2 | 10/2005 | Annamaa |
| 6,958,730 | B2 | 10/2005 | Nagumo et al. |
| 6,961,544 | B1 | 11/2005 | Hagstrom |
| 6,963,308 | B2 | 11/2005 | Korva |
| 6,963,310 | B2 | 11/2005 | Horita et al. |
| 6,967,618 | B2 | 11/2005 | Ojantakanen |
| 6,975,278 | B2 | 12/2005 | Song et al. |
| 6,985,108 | B2 | 1/2006 | Mikkola |
| 6,992,543 | B2 | 1/2006 | Luetzelschwab et al. |
| 6,995,710 | B2 | 2/2006 | Sugimoto et al. |
| 7,023,341 | B2 | 4/2006 | Stilp |
| 7,031,744 | B2 | 4/2006 | Kojima et al. |
| 7,042,403 | B2 | 5/2006 | Colburn et al. |
| 7,053,841 | B2 | 5/2006 | Ponce De Leon et al. |
| 7,054,671 | B2 | 5/2006 | Kaiponen et al. |
| 7,057,560 | B2 | 6/2006 | Erkocevic |
| 7,081,857 | B2 | 7/2006 | Kinnunen et al. |
| 7,084,831 | B2 | 8/2006 | Takagi et al. |
| 7,099,690 | B2 | 8/2006 | Milosavljevic |
| 7,113,133 | B2 | 9/2006 | Chen et al. |
| 7,119,749 | B2 | 10/2006 | Miyata et al. |
| 7,126,546 | B2 | 10/2006 | Annamaa |
| 7,136,019 | B2 | 11/2006 | Mikkola |
| 7,136,020 | B2 | 11/2006 | Yamaki |
| 7,142,824 | B2 | 11/2006 | Kojima et al. |
| 7,148,847 | B2 | 12/2006 | Yuanzhu |
| 7,148,849 | B2 | 12/2006 | Lin |
| 7,148,851 | B2 | 12/2006 | Takaki et al. |
| 7,170,464 | B2 | 1/2007 | Tang et al. |
| 7,176,838 | B1 | 2/2007 | Kinezos |
| 7,180,455 | B2 | 2/2007 | Oh et al. |
| 7,193,574 | B2 | 3/2007 | Chiang et al. |
| 7,205,942 | B2 | 4/2007 | Wang et al. |
| 7,218,280 | B2 | 5/2007 | Annamaa |
| 7,218,282 | B2 | 5/2007 | Humpfer et al. |
| 7,224,313 | B2 | 5/2007 | McKinzie, III et al. |
| 7,230,574 | B2 | 6/2007 | Johnson |
| 7,237,318 | B2 | 7/2007 | Annamaa |
| 7,256,743 | B2 | 8/2007 | Korva |
| 7,274,334 | B2 | 9/2007 | O'Riordan et al. |
| 7,283,097 | B2 | 10/2007 | Wen et al. |
| 7,289,064 | B2 | 10/2007 | Cheng |
| 7,292,200 | B2 | 11/2007 | Posluszny et al. |
| 7,319,432 | B2 | 1/2008 | Andersson |
| 7,330,153 | B2 | 2/2008 | Rentz |
| 7,333,067 | B2 | 2/2008 | Hung et al. |
| 7,339,528 | B2 | 3/2008 | Wang et al. |

(56) References Cited

U.S. PATENT DOCUMENTS

| | | | |
|---|---|---|---|
| 7,340,286 | B2 | 3/2008 | Kempele |
| 7,342,545 | B2 | 3/2008 | Huynh et al. |
| 7,345,634 | B2 | 3/2008 | Ozkar et al. |
| 7,352,326 | B2 | 4/2008 | Korva |
| 7,358,902 | B2 | 4/2008 | Erkocevic |
| 7,382,319 | B2 | 6/2008 | Kawahata et al. |
| 7,385,556 | B2 | 6/2008 | Chung et al. |
| 7,388,543 | B2 | 6/2008 | Vance |
| 7,391,378 | B2 | 6/2008 | Mikkola |
| 7,405,702 | B2 | 7/2008 | Annamaa et al. |
| 7,417,588 | B2 | 8/2008 | Castany et al. |
| 7,423,592 | B2 | 9/2008 | Pros et al. |
| 7,432,860 | B2 | 10/2008 | Huynh |
| 7,439,929 | B2 | 10/2008 | Ozkar |
| 7,468,700 | B2 | 12/2008 | Milosavlejevic |
| 7,468,709 | B2 | 12/2008 | Niemi |
| 7,498,990 | B2 | 3/2009 | Park et al. |
| 7,501,983 | B2 | 3/2009 | Mikkola |
| 7,502,598 | B2 | 3/2009 | Kronberger |
| 7,589,678 | B2 | 9/2009 | Perunka |
| 7,616,158 | B2 | 11/2009 | Mark et al. |
| 7,633,449 | B2 | 12/2009 | Oh |
| 7,663,551 | B2 | 2/2010 | Nissinen |
| 7,679,565 | B2 | 3/2010 | Sorvala |
| 7,692,543 | B2 | 4/2010 | Copeland |
| 7,710,325 | B2 | 5/2010 | Cheng |
| 7,724,204 | B2 | 5/2010 | Annamaa |
| 7,760,146 | B2 | 7/2010 | Ollikainen |
| 7,764,245 | B2 | 7/2010 | Loyet |
| 7,786,938 | B2 | 8/2010 | Sorvala |
| 7,800,544 | B2 | 9/2010 | Thornell-Pers |
| 7,830,327 | B2 | 11/2010 | He |
| 7,889,139 | B2 | 2/2011 | Hobson et al. |
| 7,889,143 | B2 | 2/2011 | Milosavljevic |
| 7,901,617 | B2 | 3/2011 | Taylor |
| 7,916,086 | B2 | 3/2011 | Koskiniemi et al. |
| 7,963,347 | B2 | 6/2011 | Pabon |
| 7,973,720 | B2 | 7/2011 | Sorvala |
| 8,049,670 | B2 | 11/2011 | Jung et al. |
| 8,179,322 | B2 | 5/2012 | Nissinen |
| 2001/0050636 | A1 | 12/2001 | Weinberger |
| 2002/0183013 | A1 | 12/2002 | Auckland et al. |
| 2002/0196192 | A1 | 12/2002 | Nagumo et al. |
| 2003/0146873 | A1 | 8/2003 | Blancho |
| 2004/0090378 | A1 | 5/2004 | Dai et al. |
| 2004/0145525 | A1 | 7/2004 | Annabi et al. |
| 2004/0171403 | A1 | 9/2004 | Mikkola |
| 2005/0057401 | A1 | 3/2005 | Yuanzhu |
| 2005/0159131 | A1 | 7/2005 | Shibagaki et al. |
| 2005/0176481 | A1 | 8/2005 | Jeong |
| 2006/0071857 | A1 | 4/2006 | Pelzer |
| 2007/0042615 | A1 | 2/2007 | Liao |
| 2007/0082789 | A1 | 4/2007 | Nissila |
| 2007/0152881 | A1 | 7/2007 | Chan |
| 2008/0055164 | A1 | 3/2008 | Zhang et al. |
| 2008/0059106 | A1 | 3/2008 | Wight |
| 2008/0088511 | A1 | 4/2008 | Sorvala |
| 2008/0252536 | A1 | 10/2008 | Anguera et al. |
| 2008/0266199 | A1 | 10/2008 | Milosavljevic |
| 2009/0009415 | A1 | 1/2009 | Tanska |
| 2009/0046022 | A1* | 2/2009 | Desclos et al. ..... 343/702 |
| 2009/0085812 | A1 | 4/2009 | Qi et al. |
| 2009/0135066 | A1 | 5/2009 | Raappana et al. |
| 2009/0174604 | A1 | 7/2009 | Keskitalo |
| 2009/0196160 | A1 | 8/2009 | Crombach |
| 2010/0220016 | A1 | 9/2010 | Nissinen |
| 2010/0244978 | A1 | 9/2010 | Milosavljevic |
| 2010/0309092 | A1 | 12/2010 | Lambacka |
| 2011/0102290 | A1 | 5/2011 | Milosavljevic |
| 2011/0133994 | A1 | 6/2011 | Korva |
| 2012/0119955 | A1 | 5/2012 | Milosavljevic |

FOREIGN PATENT DOCUMENTS

| | | | |
|---|---|---|---|
| DE | 10104862 | | 8/2002 |
| DE | 101 50 149 | A1 | 4/2003 |
| EP | 0208424 | | 1/1987 |
| EP | 0278069 | | 8/1988 |
| EP | 0279050 | | 8/1988 |
| EP | 0339822 | | 3/1989 |
| EP | 0 332 139 | | 9/1989 |
| EP | 0 376 643 | A2 | 4/1990 |
| EP | 0383292 | | 8/1990 |
| EP | 0399975 | | 12/1990 |
| EP | 0400872 | | 12/1990 |
| EP | 0401839 | | 9/1991 |
| EP | 0447218 | | 9/1994 |
| EP | 0615285 | | 10/1994 |
| EP | 0621653 | | 2/1995 |
| EP | 0 749 214 | | 12/1996 |
| EP | 0637094 | | 1/1997 |
| EP | 0 759 646 | A1 | 2/1997 |
| EP | 0 766 341 | | 2/1997 |
| EP | 0 766 340 | | 4/1997 |
| EP | 0751043 | | 4/1997 |
| EP | 0807988 | | 11/1997 |
| EP | 0 831 547 | A2 | 3/1998 |
| EP | 0851530 | | 7/1998 |
| EP | 0856907 | | 8/1998 |
| EP | 1 294 048 | | 1/1999 |
| EP | 0892459 | | 1/1999 |
| EP | 0766339 | | 2/1999 |
| EP | 0 942 488 | A2 | 9/1999 |
| EP | 1 003 240 | A2 | 5/2000 |
| EP | 1006605 | | 6/2000 |
| EP | 1006606 | | 6/2000 |
| EP | 1014487 | | 6/2000 |
| EP | 1024553 | | 8/2000 |
| EP | 1026774 | | 8/2000 |
| EP | 0999607 | | 10/2000 |
| EP | 1 052 723 | | 11/2000 |
| EP | 1052722 | | 11/2000 |
| EP | 1 063 722 | A2 | 12/2000 |
| EP | 1067627 | | 1/2001 |
| EP | 1094545 | | 4/2001 |
| EP | 1 102 348 | | 5/2001 |
| EP | 1098387 | | 5/2001 |
| EP | 1 113 524 | | 7/2001 |
| EP | 1113524 | | 7/2001 |
| EP | 1 128 466 | A2 | 8/2001 |
| EP | 1 139 490 | | 10/2001 |
| EP | 1 146 589 | | 10/2001 |
| EP | 1 162 688 | | 12/2001 |
| EP | 1162688 | | 12/2001 |
| EP | 0993070 | | 4/2002 |
| EP | 1 248 316 | | 9/2002 |
| EP | 0923158 | | 9/2002 |
| EP | 1 267 441 | | 12/2002 |
| EP | 1271690 | | 1/2003 |
| EP | 1 294 049 | A1 | 3/2003 |
| EP | 1306922 | | 5/2003 |
| EP | 1 329 980 | | 7/2003 |
| EP | 1 351 334 | | 8/2003 |
| EP | 1 361 623 | | 11/2003 |
| EP | 1248316 | | 1/2004 |
| EP | 1396906 | | 3/2004 |
| EP | 1 406 345 | | 4/2004 |
| EP | 1 414 108 | | 4/2004 |
| EP | 1 432 072 | | 6/2004 |
| EP | 1 437 793 | | 7/2004 |
| EP | 1439603 | | 7/2004 |
| EP | 1 445 822 | | 8/2004 |
| EP | 1 453 137 | | 9/2004 |
| EP | 1 469 549 | | 10/2004 |
| EP | 1220456 | | 10/2004 |
| EP | 1467456 | | 10/2004 |
| EP | 1 482 592 | | 12/2004 |
| EP | 1 498 984 | | 1/2005 |
| EP | 1 564 839 | | 1/2005 |
| EP | 1170822 | | 4/2005 |
| EP | 1 544 943 | | 6/2005 |

(56) References Cited

FOREIGN PATENT DOCUMENTS

| | | | |
|---|---|---|---|
| EP | 1753079 | | 2/2007 |
| EP | 1 791 213 | | 5/2007 |
| EP | 1843432 | | 10/2007 |
| FI | 20020829 | | 11/2003 |
| FR | 2553584 | | 10/1983 |
| FR | 2873247 | | 1/2006 |
| GB | 2266997 | | 11/1993 |
| GB | 2 360 422 | A | 9/2001 |
| GB | 239246 | | 12/2003 |
| JP | 59202831 | | 11/1984 |
| JP | 600206304 | | 10/1985 |
| JP | 61245704 | | 11/1986 |
| JP | 06152463 | | 5/1994 |
| JP | 7131234 | | 5/1995 |
| JP | 7221536 | | 8/1995 |
| JP | 7249923 | | 9/1995 |
| JP | 07307612 | | 11/1995 |
| JP | 08216571 | | 8/1996 |
| JP | 09083242 | | 3/1997 |
| JP | 9260934 | | 10/1997 |
| JP | 9307344 | | 11/1997 |
| JP | 10 028013 | | 1/1998 |
| JP | 10107671 | | 4/1998 |
| JP | 10173423 | | 6/1998 |
| JP | 10 209733 | | 8/1998 |
| JP | 10224142 | | 8/1998 |
| JP | 10 327011 | | 12/1998 |
| JP | 10322124 | | 12/1998 |
| JP | 11 004117 | | 1/1999 |
| JP | 114113 | | 1/1999 |
| JP | 11 068456 | | 3/1999 |
| JP | 11127010 | | 5/1999 |
| JP | 11127014 | | 5/1999 |
| JP | 11136025 | | 5/1999 |
| JP | 11 355033 | | 12/1999 |
| JP | 2000278028 | | 10/2000 |
| JP | 200153543 | | 2/2001 |
| JP | 2001267833 | | 9/2001 |
| JP | 2001217631 | | 10/2001 |
| JP | 2001326513 | | 11/2001 |
| JP | 2002319811 | A | 10/2002 |
| JP | 2002329541 | | 11/2002 |
| JP | 2002335117 | | 11/2002 |
| JP | 200360417 | | 2/2003 |
| JP | 2003124730 | | 4/2003 |
| JP | 2003179426 | | 6/2003 |
| JP | 2003318638 | | 11/2003 |
| JP | 2004112028 | | 4/2004 |
| JP | 2004363859 | | 12/2004 |
| JP | 2005005985 | | 1/2005 |
| JP | 2005252661 | | 9/2005 |
| KR | 20010080521 | | 10/2001 |
| KR | 10-2006-7027462 | | 12/2002 |
| KR | 20020096016 | | 12/2002 |
| SE | 511900 | | 12/1999 |
| WO | WO 92/00635 | | 1/1992 |
| WO | WO 96/27219 | | 9/1996 |
| WO | WO 98/01919 | | 1/1998 |
| WO | WO 98/01921 | | 1/1998 |
| WO | WO 98/37592 | | 8/1998 |
| WO | WO 99/30479 | | 6/1999 |
| WO | WO 00/36700 | | 6/2000 |
| WO | WO 01/20718 | | 3/2001 |
| WO | WO 01/24316 | | 4/2001 |
| WO | WO 01/28035 | | 4/2001 |
| WO | WO 01/29927 | | 4/2001 |
| WO | WO 01/33665 | | 5/2001 |
| WO | WO 01/61781 | | 8/2001 |
| WO | WO 01/91236 | | 11/2001 |
| WO | WO 02/08672 | | 1/2002 |
| WO | WO 02/11236 | A1 | 2/2002 |
| WO | WO 02/13307 | | 2/2002 |
| WO | WO 02/41443 | | 5/2002 |
| WO | WO 02/067375 | | 8/2002 |
| WO | WO 02/078123 | | 10/2002 |
| WO | WO 02/078124 | | 10/2002 |
| WO | WO 03/094290 | | 11/2003 |
| WO | WO 2004/017462 | | 2/2004 |
| WO | WO 2004/036778 | | 4/2004 |
| WO | WO 2004/057697 | | 7/2004 |
| WO | WO 2004/070872 | | 8/2004 |
| WO | WO 2004/100313 | | 11/2004 |
| WO | WO 2004/112189 | A | 12/2004 |
| WO | WO 2005/011055 | | 2/2005 |
| WO | WO 2005/018045 | | 2/2005 |
| WO | WO 2005/034286 | | 4/2005 |
| WO | WO 2005/038981 | A1 | 4/2005 |
| WO | WO 2005/055364 | | 6/2005 |
| WO | WO 2005/062416 | | 7/2005 |
| WO | WO 2006/000631 | A1 | 1/2006 |
| WO | WO 2006/000650 | | 1/2006 |
| WO | WO 2006/051160 | A1 | 5/2006 |
| WO | WO 2006/084951 | A1 | 8/2006 |
| WO | WO 2006/097567 | | 9/2006 |
| WO | WO 2007/000483 | | 1/2007 |
| WO | WO 2007/000483 | A1 | 1/2007 |
| WO | WO 2007/012697 | | 2/2007 |
| WO | WO 2007/039667 | | 4/2007 |
| WO | WO 2007/039668 | | 4/2007 |
| WO | WO 2007/042614 | | 4/2007 |
| WO | WO 2007/042615 | | 4/2007 |
| WO | WO 2007/050600 | | 5/2007 |
| WO | WO 2007/080214 | | 7/2007 |
| WO | WO 2007/098810 | | 9/2007 |
| WO | WO 2007/138157 | | 12/2007 |
| WO | WO 2008/059106 | | 3/2008 |
| WO | WO 2008/129125 | | 10/2008 |
| WO | WO 2009/027579 | | 5/2009 |
| WO | WO 2009/095531 | | 8/2009 |
| WO | WO 2009/106682 | | 9/2009 |

OTHER PUBLICATIONS

"Dual Band Antenna for Hand Held Portable Telephones", Liu et al., Electronics Letters, vol. 32, No. 7, 1996, pp. 609-610.

"Improved Bandwidth of Microstrip Antennas using Parasitic Elements," IEE Proc. vol. 127, Pt. H. No. 4, Aug. 1980.

"A 13.56MHz RFID Device and Software for Mobile Systems", by H. Ryoson, et al., Micro Systems Network Co., 2004 IEEE, pp. 241-244.

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., 2003 pp. 15-24, waelsall@rockwellcollins.com and blhauck@rockwellcollins.com.

Abedin, M. F. and M. Ali, "Modifying the ground plane and its erect on planar inverted-F antennas (PIFAs) for mobile handsets," *IEEE Antennas and Wireless Propagation Letters*, vol. 2, 226-229, 2003.

C. R. Rowell and R. D. Murch, "A compact PIFA suitable for dual frequency 900/1800-MHz operation," *IEEE Trans. Antennas Propag.*, vol. 46, No. 4, pp. 596-598, Apr. 1998.

Cheng-Nan Hu, Willey Chen, and Book Tai, "A Compact Multi-Band Antenna Design for Mobile Handsets", APMC 2005 Proceedings.

Endo, T., Y. Sunahara, S. Satoh and T. Katagi, "Resonant Frequency and Radiation Efficiency of Meander Line Antennas," Electronics and Commu-nications in Japan, Part 2, vol. 83, No. 1, 52-58, 2000.

European Office Action, May 30, 2005 issued during prosecution of EP 04 396 001.2-1248.

Examination Report dated May 3, 2006 issued by the EPO for European Patent Application No. 04 396 079.8.

F.R. Hsiao, et al. "A dual-band planar inverted-F patch antenna with a branch-line slit," *Microwave Opt. Technol. Lett.*, vol. 32, Feb. 20, 2002.

Griffin, Donald W. et al., "Electromagnetic Design Aspects of Packages for Monolithic Microwave Integrated Circuit-Based Arrays with Integrated Antenna Elements", IEEE Transactions on Antennas and Propagation, vol. 43, No. 9, pp. 927-931, Sep. 1995.

Guo, Y. X. and H. S. Tan, "New compact six-band internal antenna," *IEEE Antennas and Wireless Propagation Letters*, vol. 3, 295-297, 2004.

(56) References Cited

OTHER PUBLICATIONS

Guo, Y. X. and Y.W. Chia and Z. N. Chen, "Miniature built-in quadband antennas kir mobile handsets", IEEE Antennas Wireless Propag. Lett., vol. 2, pp. 30-32, 2004.
Hoon Park, et al. "Design of an Internal antenna with wide and multiband characteristics for a mobile handset", *IEEE Microw. & Opt. Tech. Lett.* vol. 48, No. 5, May 2006.
Hoon Park, et al. "Design of Planar Inverted-F Antenna With Very Wide Impedance Bandwidth", *IEEE Microw. & Wireless Comp., Lett.*, vol. 16, No. 3, pp. 113-115-, Mar. 2006.
Hossa, R., A. Byndas, and M. E. Bialkowski, "Improvement of compact terminal antenna performance by incorporating open-end slots in ground plane," *IEEE Microwave and Wireless Components Letters*, vol. 14, 283-285, 2004.
I. Ang, Y. X. Guo, and Y. W. Chia, "Compact internal quad-band antenna for mobile phones" *Micro. Opt. Technol. Lett.*, vol. 38, No. 3 pp. 217-223 Aug. 2003.
International Preliminary Report on Patentability for International Application No. PCT/FI2004/000554, date of issuance of report May 1, 2006.
Jing, X., et al.; "Compact Planar Monopole Antenna for Multi-Band Mobile Phones"; Microwave Conference Proceedings, 4.-7.12.2005. APMC 2005, Asia-Pacific Conference Proceedings, vol. 4.
Kim, B. C., J. H. Yun, and H. D. Choi, "Small wideband PIFA for mobile phones at 1800 MHz," *IEEE International Conference on Vehicular Technology*, 27{29, Daejeon, South Korea, May 2004.
Kim, Kihong et al., "Integrated Dipole Antennas on Silicon Substrates for Intra-Chip Communication", IEEE, pp. 1582-1585, 1999.
Kivekas., O., J. Ollikainen, T. Lehtiniemi, and P. Vainikainen, "Bandwidth, SAR, and eciency of internal mobile phone antennas," *IEEE Transactions on Electromagnetic Compatibility*, vol. 46, 71{86, 2004.
K-L Wong, *Planar Antennas for Wireless Communications.*, Hoboken, NJ: Willey, 2003, ch. 2.
Lindberg., P. and E. Ojefors, "A bandwidth enhancement technique for mobile handset antennas using wavetraps," *IEEE Transactions on Antennas and Propagation*, vol. 54, 2226{2232, 2006.
Marta Martinez-Vazquez, et al., "Integrated Planar Multiband Antennas for Personal Communication Handsets", *IEEE Trasactions on Antennas and propagation*, vol. 54, No. 2, Feb. 2006.
P. Ciais, et al., "Compact Internal Multiband Antennas for Mobile and WLAN Standards", *Electronic Letters*, vol. 40, No. 15, pp. 920-921, Jul. 2004.
P. Ciais, R. Staraj, G. Kossiavas, and C. Luxey, "Design of an internal quadband antenna for mobile phones", *IEEE Microwave Wireless Comp. Lett.*, vol. 14, No. 4, pp. 148-150, Apr. 2004.
P. Salonen, et al. "New slot configurations for dual-band planar inverted-F antenna," *Microwave Opt. Technol.*, vol. 28, pp. 293-298, 2001.
Papapolymerou, Ioannis et al, "Micromachined Patch Antennas", IEEE Transactions on Antennas and Propagation, vol. 46, No. 2, pp. 275-283, Feb. 1998.
Product of the Month, RFDesign, "GSM/GPRS Quad Band Power Amp Includes Antenna Switch," 1 page, reprinted Nov. 2004 issue of RF Design (www.rfdesign.com), Copyright 2004, Freescale Semiconductor, RFD-24-EK.
S. Tarvas, et al. "An internal dual-band mobile phone antenna," in *2000 IEEE Antennas Propagat. Soc. Int. Symp. Dig.*, pp. 266-269, Salt Lake City, UT, USA.
Wang, F., Z. Du, Q. Wang, and K. Gong, "Enhanced-bandwidth PIFA with T-shaped ground plane," *Electronics Letters*, vol. 40, 1504-1505, 2004.
Wang, H.; "Dual-Resonance Monopole Antenna with Tuning Stubs"; IEEE Proceedings, Microwaves, Antennas & Propagation, vol. 153, No. 4, Aug. 2006; pp. 395-399.
Wong, K., et al.; "A Low-Profile Planar Monopole Antenna for Multiband Operation of Mobile Handsets"; IEEE Transactions on Antennas and Propagation, Jan. '03, vol. 51, No. 1.
X.-D. Cal and J.-Y. Li, Analysis of asymmetric TEM cell and its optimum design of electric field distribution, IEE Proc 136 (1989), 191-194.
X.-Q. Yang and K.-M. Huang, Study on the key problems of interaction between microwave and chemical reaction, Chin Jof Radio Sci 21 (2006), 802-809.
Chiu, C.-W., et al., "A Meandered Loop Antenna for LTE/WWAN Operations in a Smartphone," Progress in Electromagnetics Research C, vol. 16, pp. 147-160, 2010.
Lin, Sheng-Yu; Liu, Hsien-Wen; Weng, Chung-Hsun; and Yang, Chang-Fa, "A miniature Coupled loop Antenna to be Embedded in a Mobile Phone for Penta-band Applications," Progress in Electromagnetics Research Symposium Proceedings, Xi'an, China, Mar. 22-26, 2010, pp. 721-724.
Zhang, Y.Q., et al. "Band-Notched UWB Crossed Semi-Ring Monopole Antenna," Progress in Electronics Research C, vol. 19, 107-118, 2011, pp. 107-118.
Singh, Rajender, "Broadband Planar Monopole Antennas," M.Tech credit seminar report, Electronic Systems group, EE Dept, IIT Bombay, Nov. 2003, pp. 1-24.
Gobien, Andrew, T. "*Investigation of Low Profile Antenna Designs for Use in Hand-Held Radios*,"Ch.3, *The Inverted-L Antenna and Variations*; Aug. 1997, pp. 42-76.
See, C.H., et al, "Design of Planar Metal-Plate Monopole Antenna for Third Generation Mobile Handsets," Telecommunications Research Centre, Bradford University, 2005, pp. 27-30.
"LTE—an introduction," Ericsson White Paper, Jun. 2009, pp. 1-16.
"Spectrum Analysis for Future LTE Deployments," Motorola White Paper, 2007, pp. 1-8.
Chi, Yun-Wen, et al. "Quarter-Wavelength Printed Loop Antenna With an Internal Printed Matching Circuit for GSM/DCS/PCS/UMTS Operation in the Mobile Phone," IEEE Transactions on Antennas and Propagation, vol. 57, No. 9m Sep. 2009, pp. 2541-2547.
Wong, Kin-Lu, et al. "Planar Antennas for WLAN Applications," Dept. of Electrical Engineering, National Sun Yat-Sen University, 2002 09 Ansoft Workshop, pp. 1-45.
"λ/4 printed monopole antenna for 2.45GHz," Nordic Semiconductor, White Paper, 2005, pp. 1-6.
White, Carson, R., "Single- and Dual-Polarized Slot and Patch Antennas with Wide Tuning Ranges," The University of Michigan, 2008.

* cited by examiner

LOOP RESONATOR APPARATUS AND METHODS FOR ENHANCED FIELD CONTROL

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

The present invention relates generally to internal antennas for use in portable radio devices and more particularly in one exemplary aspect to a passive loop resonator structure to control antenna ground plane field distribution in order to improve hearing aid compliance, and methods of utilizing and manufacturing the same.

DESCRIPTION OF RELATED TECHNOLOGY

Internal antennas are an element found in most modern portable radio devices, such as mobile phones, Blackberry® devices, smartphones, personal digital assistants (PDAs), or other personal communication devices (PCD). Typically, these antennas comprise a planar radiating plane and a ground plane parallel thereto, which are connected to each other by a short-circuit conductor in order to achieve the matching of the antenna. The structure is dimensioned so that it functions as a resonator at the operating frequency. It is a common requirement that the antenna operate in more than one frequency band (such as dual band, tri-band, or quad-band mobile phones) in which case two or more resonators are used.

Typically, internal antennas are constructed to comprise at least a part of a printed wired board (PWB) assembly, also commonly referred to as the printed circuit board (PCB). FIG. 1A shows a typical configuration of the PWB 100 in a mobile radio device. The PWB 100 comprises a ground plane 102, monopole antenna 104 disposed proximate to one end 110 of the PWB (on the opposite side from ground plane 102), and an earpiece 108 (speaker) located a distance from the antenna 104 (e.g., on the opposite end from the antenna). Such configuration is typically chosen to optimize mobile phone packaging volume, and/or to minimize interference between the antenna active element 104 and earpiece 108.

FIG. 1B depicts an electromagnetic field distribution across the PWB ground plane 102 that is induced by antenna element 104 of FIG. 1*a*, which is modeled as a half wave dipole. As seen from FIG. 1A, electrical (E) field maxima 118 and 120 are located proximate to the ends 110 and 106 of the PWB longest dimension 124. Therefore, the there is an excess of electric field energy proximate to the location of the earpiece 108. This configuration creates potential obstacles for using mobile phones with hearing aids, in particular in obtaining hearing aid compliance.

For example, the Hearing Aid Compatibility Act of 1988 (HAC Act) mandated that all telephones made or imported into the United States be compatible with hearing aids, but specifically exempted mobile telephones. In July 2003, the Federal Communications Commission FCC modified the HAC Act's exemption for mobile phones, mandating that manufacturers provide certain numbers of models or percentages of mobile phones that are hearing aid compatible HAC by 2005 and 2008.

Increased electric field energy in the vicinity of the earpiece results in high field values in the hearing aid compliance measurement. Numerous methodologies exist for reducing electrical interference and improving hearing aid compliance in mobile radio devices, including for example, those disclosed in U.S. Pat. No. 6,009,311 to Killion, et al. issued Dec. 28, 1999, and entitled "Method and apparatus for reducing audio interference from cellular telephone transmissions"; United States Patent Pub. No. 2009/0243944 to Jung, et al. published Oct. 1, 2001, and entitled "Portable Terminal"; United States Patent Pub No. 2009/0219214 to Oh published Sep. 3, 2009 and entitled "Wireless handset with improved hearing aid compatibility"; U.S. Pat. No. 5,442,280 to Johnson, issued Oct. 28, 2003 and entitled "Device and method of use for reducing hearing aid RF interference", each of the foregoing being incorporated herein by reference in its entirety. However, exiting approaches require additional energy absorbing elements, electric field reducing units, external field shaping conductors, and/or signal processing methods that add cost and complexity.

The prior art commonly addresses the HAC requirements for mobile phones by implementing monopole grounded resonator strips on both ends 110 and 106 of the PWB 100 in order to change the electric field distribution. This approach inherently has drawbacks, such as increased PWB size, and makes mechanical implementation difficult. For instance, in the low band, the antenna becomes more sensitive to dielectric loading from mechanics and user body parts, and additional contacts between the PWB ground plane and the device mechanics are required.

Therefore, there is a salient need for apparatus and methods for altering radio antenna ground field distribution in mobile radio devices so as to reduce electric field interference, and improve hearing aid compliance for mobile phones and other mobile radio devices.

SUMMARY OF THE INVENTION

The present invention satisfies the foregoing needs by providing, inter alia, a loop resonator structure and associated methods which alter antenna ground plane field distribution.

In a first aspect of the invention, an antenna assembly for use in a mobile wireless device is disclosed. In one embodiment, said antenna comprises: a dielectric element having a longitudinal direction and a transverse direction and first and second substantially planar sides; a conductive coating deposited on the first substantially planar side forming a ground plane; a radiating element disposed on the second substantially planar side; an audio component disposed at least partly on the first planar side; and a resonant element having a longitudinal dimension and a transverse dimension and formed at least partially on said ground plane proximate to one longitudinal side of said dielectric element, said resonant element further comprising a first portion and a second portion. The conductive coating is removed from beneath said first and second portions thus forming an opening on said one longitudinal side, and a resonance is formed substantially between the first portion and the second portion.

In one variant, the assembly further comprises a capacitive element electrically coupled to said ground plane between a first side and a second side of said opening.

In another variant, said resonant element comprises a resonance having a center frequency of approximately 1880

MHz. In yet another variant, said resonant element comprises a resonance having a center frequency below 900 MHz.

In a further variant, said audio component comprises a speaker.

In a second aspect of the invention, a method of tuning an antenna for use in a mobile device is disclosed. In one embodiment, the mobile device further comprise an audio component, and said method comprises: disposing at least one resonator element onto a ground plane of said antenna, said element comprising at least a capacitance and an inductance; selecting said capacitance to create a electric resonance at a first frequency, and adjusting location of said resonator element on said ground plane to optimize an electric field distribution across said ground plane. The optimization of said electric field distribution comprises reducing an electric field strength at a location proximate to said audio component.

In one variant, said audio component comprises a speaker, and said tuning comprises tuning so that said antenna is compliant with at least one hearing aid compatibility standard or requirement (e.g., the Hearing Aid Compatibility Act of 1988 (HAC Act) as amended in 2003).

In another variant, the electric resonance is formed between said capacitance and said inductance.

In a third aspect of the invention, a method of altering the electric field distribution across a ground plane of a mobile device antenna is disclosed. In one embodiment, said method comprises: disposing a resonator element onto antenna ground plane, said resonator element comprising at least a capacitance and inductance; selecting said capacitance to form a resonance at a first frequency; and adjusting a location of said resonator element on said ground plane to optimize and electric field distribution across said ground plane.

In one variant, said mobile device further comprises an electrically sensitive component disposed proximate said ground plane, and said act of adjusting a location comprises adjusting said location so that an electric field strength is minimized substantially coincident with a location of said electrically sensitive component. The electrically sensitive component comprises an audio speaker, and said act of adjusting a location enables said mobile device to be compliant with a hearing aid audio-related requirement.

In a fourth aspect of the invention, a method of enabling hearing aid compliance is disclosed. In one embodiment, the method is adapted for use in a mobile radio device comprising a ground plane, an antenna and an audio component, and comprises: providing at least one resonator element for use on a ground plane of said antenna, said at least one resonator element comprising at least a capacitance and an inductance, said capacitance configured to form a resonance at a first frequency; and disposing said at least one resonator element on said ground plane at a location selected to reduce electric field strength proximate to said audio component location, thereby reducing interference of said antenna with said audio component and effecting said hearing aid compliance.

In a fifth aspect of the invention, an antenna for use in a mobile radio device is disclosed. In one embodiment, the antenna comprises: a ground plane; and at least one resonator element disposed on said ground plane of said antenna, said at least one resonator element comprising at least a capacitance and an inductance and configured to form a resonance at a first frequency. The at least one resonator element is disposed on said ground plane at a selected first location so as to reduce electric field strength at a second location.

In one variant, said mobile radio device comprises an interference-sensitive component, and said second location is proximate to a location of said interference-sensitive component, said reduced electrical field strength thereby reducing interference of said antenna with said interference-sensitive component.

In another variant, the interference-sensitive component comprises an audio component.

In yet another variant, said interference-sensitive component comprises an electric coil component.

In still a further variant, said at least one resonator element comprises a loop-type shape having at least one gap formed therein. The at least one gap comprises e.g., a single gap formed proximate a longitudinal edge of a substrate onto which said ground plane is formed.

In a sixth aspect of the invention, a method of operating an antenna within a mobile device is disclosed. In one embodiment, the method comprises: receiving an antenna input signal from an electronic component of said mobile device; and creating a resonance within a resonator element of said antenna based at least in part on said input signal and a capacitance of said resonator element, said capacitance at least in part causing an electric field generated by way of said resonance to be mitigated in a desired location on said antenna while still emitting a desired radio frequency signal from said antenna.

In a seventh aspect of the invention, a method of designing a mobile device antenna is disclosed. In one embodiment, the method is adapted for design of a HAC-compliant antenna, and comprises selecting a readily identifiable location for one or more resonators on a PWB, and disposing the one or more resonators at that location on the PWB so as to suppress electric field strength at another desired location on the PWB. This process obviates the need for computerized simulation of E- and H-fields for the device.

In an eighth aspect of the invention, a mobile device is disclosed. In one embodiment, the mobile device is adapted to radiate wireless signals via a substantially planar form factor antenna having a resonator, which mitigates at least one electric field intensity level at a desired location within the mobile device, so as to mitigate interference with interference-sensitive components such as audio earpieces. In one variant, the mobile device comprises a cellular telephone or smartphone adapted to radiate at approximately 1900 MHz.

These and other embodiments, aspects, advantages, and features of the present invention will be set forth in part in the description which follows, and in part will become apparent to those skilled in the art by reference to the following description of the invention and referenced drawings or by practice of the invention.

BRIEF DESCRIPTION OF THE DRAWINGS

The features, objectives, and advantages of the invention will become more apparent from the detailed description set forth below when taken in conjunction with the drawings, wherein.

Figure 1A:
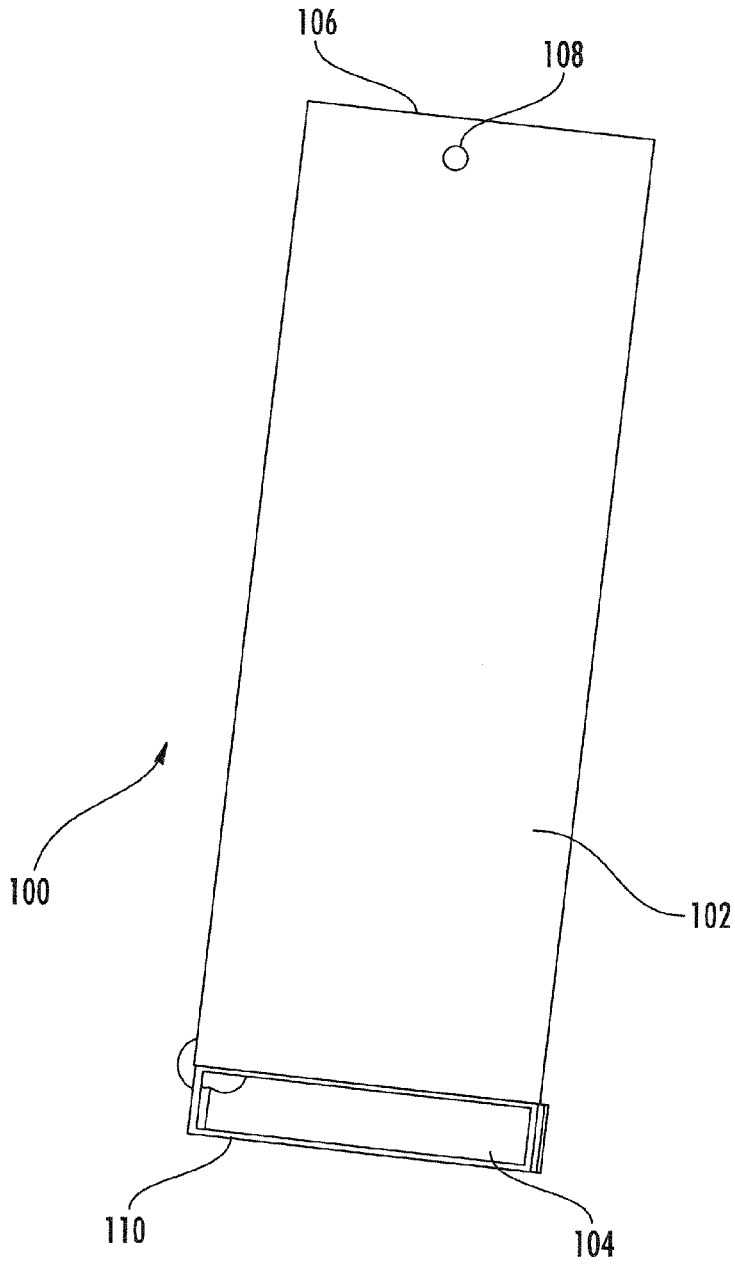
FIG. 1A is a top view illustrating atypical mobile radio device antenna configuration according to prior art.
Figure 1C:
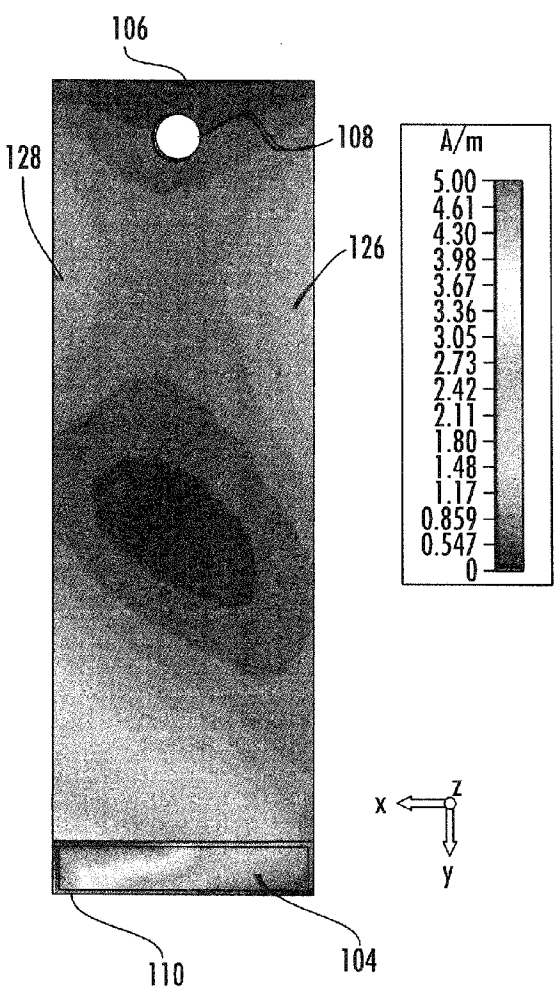
FIG. 1C illustrates magnetic intensity (H-field) simulations for the device of FIG. 1A.

All Figures disclosed herein are © Copyright 2009 Pulse Engineering, Inc. All rights reserved.

DETAILED DESCRIPTION OF THE PREFERRED EMBODIMENT

Reference is now made to the drawings wherein like numerals refer to like parts throughout.

As used herein, the terms "board" and "substrate" refer generally and without limitation to any substantially planar or curved surface or component upon which other components can be disposed. For example, a substrate may comprise a single or multi-layered printed circuit board (e.g., FR4), a semi-conductive die or wafer, or even a surface of a housing or other device component, and may be substantially rigid or alternatively at least somewhat flexible.

As used herein, the terms "radiator," "radiating plane," and "radiating element" refer without limitation to an element that can function as part of a system that receives and/or transmits radio-frequency electromagnetic radiation; e.g., an antenna.

The terms "feed," "RF feed," "feed conductor," and "feed network" refer without limitation to any energy conductor and coupling element(s) that can transfer energy, transform impedance, enhance performance characteristics, and conform impedance properties between an incoming/outgoing RF energy signals to that of one or more connective elements, such as for example a radiator.

Furthermore, the terms "antenna," "antenna system," and "multi-band antenna" refer without limitation to any system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like. The energy may be transmitted from location to another location, using, or more repeater links, and one or more locations may be mobile, stationary, or fixed to a location on earth such as a base station.

The terms "communication systems" and communication devices" refer to without limitation any services, methods, or devices that utilize wireless technology to communicate information, data, media, codes, encoded data, or the like from one location to another location.

The terms "frequency range", "frequency band", and "frequency domain" refer to without limitation any frequency range for communicating signals. Such signals may be communicated pursuant to one or more standards or wireless air interfaces As used herein, the terms "electrical component" and "electronic component" are used interchangeably and refer to components adapted to provide some electrical function, including without limitation inductive reactors ("choke coils"), transformers, filters, gapped core toroids, inductors, capacitors, resistors, operational amplifiers, and diodes, whether discrete components or integrated circuits, whether alone or in combination.

As used herein, the term "integrated circuit" or "IC)" refers to any type of device having any level of integration (including without limitation ULSI, VLSI, and LSI) and irrespective of process or base materials (including, without limitation Si, SiGe, CMOS and GaAs). ICs may include, for example, memory devices (e.g., DRAM, SRAM, DDRAM, EEPROM/Flash, ROM), digital processors, SoC devices, FPGAs, ASICs, ADCs, DACs, transceivers, memory controllers, and other devices, as well as any combinations thereof.

As used herein, the term "memory" includes any type of integrated circuit or other storage device adapted for storing digital data including, without limitation, ROM. PROM, EEPROM, DRAM, SDRAM, DDR/2 SDRAM, EDO/FPMS, RLDRAM, SRAM, "flash" memory (e.g., NAND/NOR), and PSRAM.

As used herein, the terms "microprocessor" and "digital processor" are meant generally to include all types of digital processing devices including, without limitation, digital signal processors (DSPs), reduced instruction set computers (RISC), general-purpose (CISC) processors, microprocessors, gate arrays (e.g., FPGAs), PLDs, reconfigurable compute fabrics (RCFs), array processors, and application-specific integrated circuits (ASICs). Such digital processors may be contained on a single unitary IC die, or distributed across multiple components.

As used herein, the terms "mobile device", "client device", "peripheral device" and "end user device" include, but are not limited to, personal computers (PCs) and minicomputers, whether desktop, laptop, or otherwise, set-top boxes, personal digital assistants (PDAs), handheld computers, personal communicators, J2ME equipped devices, cellular telephones, smartphones, personal integrated communication or entertainment devices, or literally any other device capable of interchanging data with a network or another device.

As used herein, the term "hearing aid" refers without limitation to a device that aids a person's hearings, for example, devices that condition or modify sounds (e.g., amplify, attenuate, and/or filter), as well as devices that deliver sound to a specific person such as headsets for portable music players or radios.

As used herein, the term "signal conditioning" or "conditioning" shall be understood to include, but not be limited to, signal voltage transformation, filtering and noise mitigation, signal splitting, impedance control and correction, current limiting, capacitance control, and/or time delay.

As used herein, the terms "top", "bottom", "side", "up", "down" and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), analog cellular, CDPD, satellite systems, millimeter wave or microwave systems, optical, acoustic, and infrared (i.e., IrDA).

Overview

The present invention provides, in one salient aspect, an antenna apparatus and mobile radio device with improved hearing aid compliance, and methods for manufacturing and utilizing the same. In one embodiment, the mobile radio device comprises a printed wired board (PWB) with a monopole antenna and an ear piece disposed on substantially opposing ends of the PWB. A loop resonator is formed on the PWB ground plane. The loop resonator is constructed so as to form a conductor-free area on the PWB and a gap in the PWB ground plane proximate to the edge of the PWB. The loop resonator forms an LC resonator structure where the capacitance is determined by the loop perimeter, and the inductance is determined by the PWB gap opening. The resonator dimensions are chosen so as to achieve sufficient inductance required for proper coupling to a PWB resonant mode.

Placement of the loop resonant structure onto the PWB alters the electromagnetic field distribution across the PWB ground plane. By placing the loop resonator apparatus on the PWB edge(s), the PWB electrical length is modified so that the PWB has an electric field maximum disposed at a location closer to the antenna, and a minimum disposed at an end that is proximate to the earpiece. The electric field strength proximate the earpiece is reduced, therefore advantageously diminishing potential electromagnetic interference with hearing aid devices and hence facilitating hearing aid compliance of the mobile radio device.

Different loop resonator placement options may be implemented according to different exemplary embodiments. In a first embodiment, placement of the loop resonator apparatus proximate the location of the magnetic intensity (H) maximum on the PWB produced the largest electric field reduction at the earpiece location. In a second embodiment, when the loop resonator apparatus is installed substantially at the mid-point of the PWB, the electric field reduction is not as substantial as compared to the prior embodiment. However, as the determination of the mid-point location is typically more straightforward, this second embodiment provides a lower-cost implementation alternative. Yet other locations are also contemplated under the invention.

In another exemplary embodiment, the antenna and the earpiece are disposed substantially at the same end of the PWB to allow for a smaller PWB dimensions. A pair of loop resonators is disposed along the opposing edges of the PWB in order to reduce electric field strength at the earpiece location, thus effecting hearing aid compliance.

A method for tuning one or more antenna in a mobile radio device is also disclosed. The method in one embodiment comprises using one or more loop resonators to shift an E-field local minimum as close to the earpiece location as possible. By changing the resonator(s) location along PWB edges relative to antenna element, the local E-field minimum is moved proximate to the earpiece location, where HAC is typically measured. Fine tuning of the resonator location, dimensions, capacitance and inductance is further used to set the effective electrical length of the PWB, in order to support high band antenna operation, and increase antenna efficiency bandwidth in small antenna cases. Accordingly, E-field distribution can be made more symmetrical, and provide the opportunity for the E-field "null" to be moved towards a desired location.

DETAILED DESCRIPTION OF EXEMPLARY EMBODIMENTS

Detailed descriptions of the various embodiments and variants of the apparatus and methods of the invention are now provided. While primarily discussed in the context of mobile devices, the various apparatus and methodologies discussed herein are not so limited. In fact, many of the apparatus and methodologies described herein are useful in the manufacture of any number of complex antennas that can benefit from the segmented manufacturing methodologies and apparatus described herein, including devices that do not utilize or need a pass-through or return conductor, whether fixed, portable, or otherwise.

Exemplary Antenna Apparatus

Referring now to FIGS. 1-12, exemplary embodiments of the mobile radio antenna apparatus of the invention are described in detail.

It will be appreciated that while these exemplary embodiments of the antenna apparatus of the invention are implemented using a loop resonator technology due to its desirable attributes and performance, the invention is in no way limited to loop resonator-based configurations, and in fact can be implemented using other technologies.

Figure 2A:
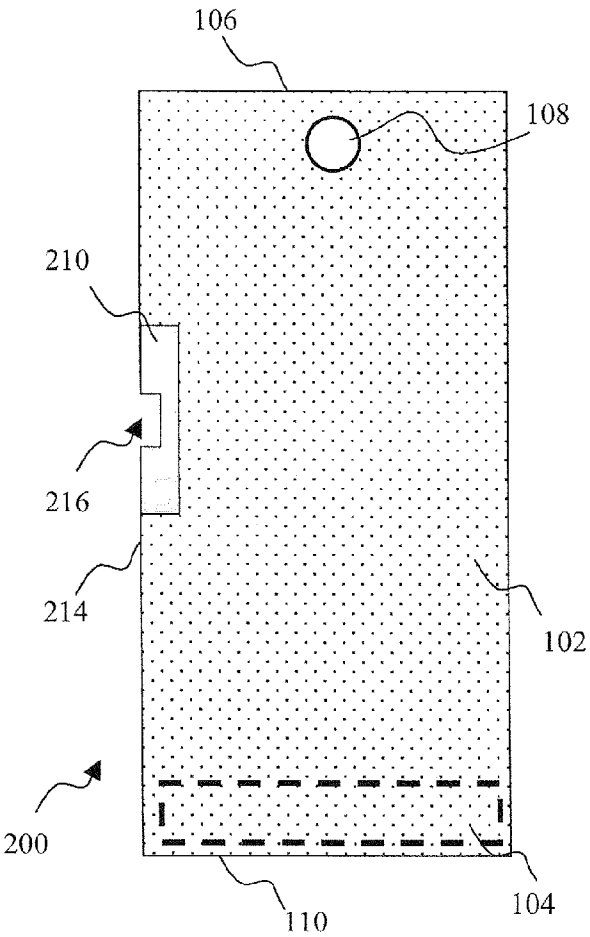
FIG. 2A is a top view of an antenna configuration in accordance with one embodiment of the present invention.

FIG. 2A illustrates one embodiment of a mobile radio device PWB in accordance with one embodiment of the present invention. The PWB 200 comprises a rectangular substrate element with a conductive coating deposited on the front planar face of the substrate element, so as to form a ground plane 102. An antenna 104 is disposed proximate to one (horizontal) end 110 of the PWB 200. An earpiece 108 (here, a speaker) is located proximate the opposite PWB end 106 away from antenna 104. Typically, the PWB size and shape is bounded by the mechanical outline of the specific mobile device, and determined by other features such as accommodating other device components (e.g., battery, display, etc.). A configuration as shown in FIG. 2A is commonly chosen so as to optimize mobile phone packaging volume, and to minimize interference between the antenna 104 and the earpiece 108. A loop resonator structure 210 is disposed on the ground plane 202 proximate the vertical side 214 of the PWB 200. The exemplary PWB 200 according to one embodiment comprises a rectangular shape of about 110 mm (4.3 in.) in length, and 40 mm (1.6 in.) in width, and the dimensions of the exemplary antenna is are 40×8 mm (1.6×0.2 in.). As persons skilled in the art will appreciate, the dimensions given above may be modified as required by the particular application. While the vast majority of presently offered mobile phones and personal communication devices typically feature a bar (e.g., so-called "candy bar") or a flip configuration with a rectangular outline, there are other designs that utilize other shapes (such as e.g., the Nokia 77XX Twist™, which uses a substantially square shape).

Moreover, although a single earpiece is shown for clarity, it is appreciated that alternative implementations are available that include a plurality (two or more) speakers such as in the LG enV®3 or Samsung SCH-F609 devices.

Figure 2B:
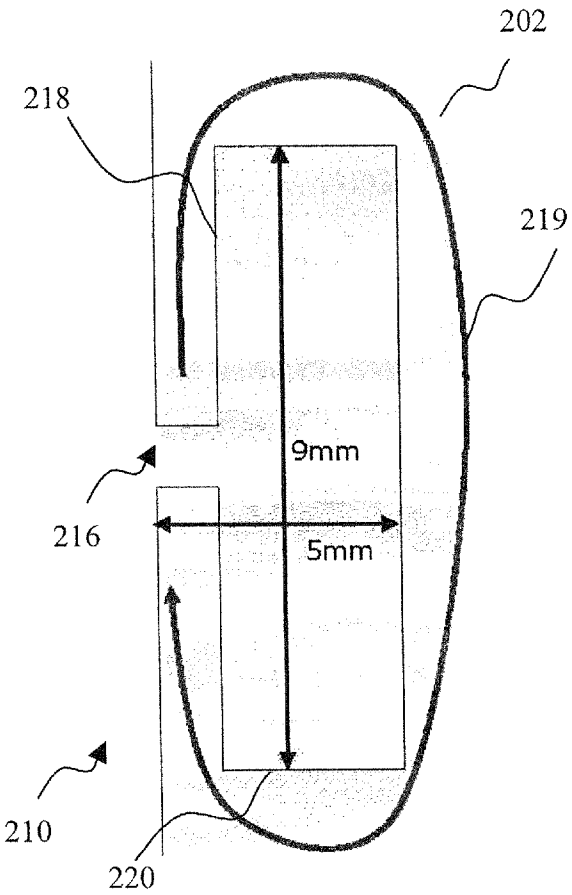
FIG. 2B is top view depicting a section of the antenna configuration of FIG. 2A showing the detailed structure of loop resonator in accordance with one embodiment of the present invention.

Referring now to FIG. 2B, the structure of one embodiment of the loop resonator 210 is shown in detail. The loop resonator 210 is typically formed by etching a portion of the conductive coating from PWB ground plane 202. The etched portion is substantially a dielectric substrate, and it comprises a rectangle with the longer dimension 218 oriented parallel with the antenna main dipole axis. For the antenna configuration shown in FIG. 2B, the main axis is oriented vertically, and the loop resonator 210 is placed proximate to the vertical side 214 of the PWB.

The removal of the conductive coating creates an opening 216 in PWB vertical side 214, as shown.

In another embodiment, the PWB comprises a square shaped structure, and the loop resonator is placed proximate either the horizontal or vertical edge of the PWB (provided it is placed effectively parallel with the antenna main dipole-like axis).

The exemplary loop structure according to the embodiment shown in FIG. 2B is 9 mm in length and 5 mm in width (roughly 0.3×0.2 in.). The loop dimensions 218 and 220 are chosen so as to achieve sufficient inductance required for proper coupling to the PWB resonant mode.

The dimensions of the resonator loop that optimize the electrical current path length are determined using a combination of computer modeling and measurements for each antenna configuration. Typically, shorter loop lengths require larger capacitance values. However this combination produces narrower band resonance within the loop. To effectively couple the resonator loop to the ground plane resonance, it is desirable to maximize the loop dimension normal to ground plane edge, while taking into consideration the PWB layout design compactness.

The dimensions shown above have been used in simulation, with an air-filled opening on the ground plane. As persons skilled in the art will appreciate given the present disclosure, the foregoing dimensions may be modified as required by the particular application. Moreover, the configurations of the embodiments presented in FIGS. 2A and 2B are but only a small portion of the myriad of possible alternatives and variations.

Figure 2C:
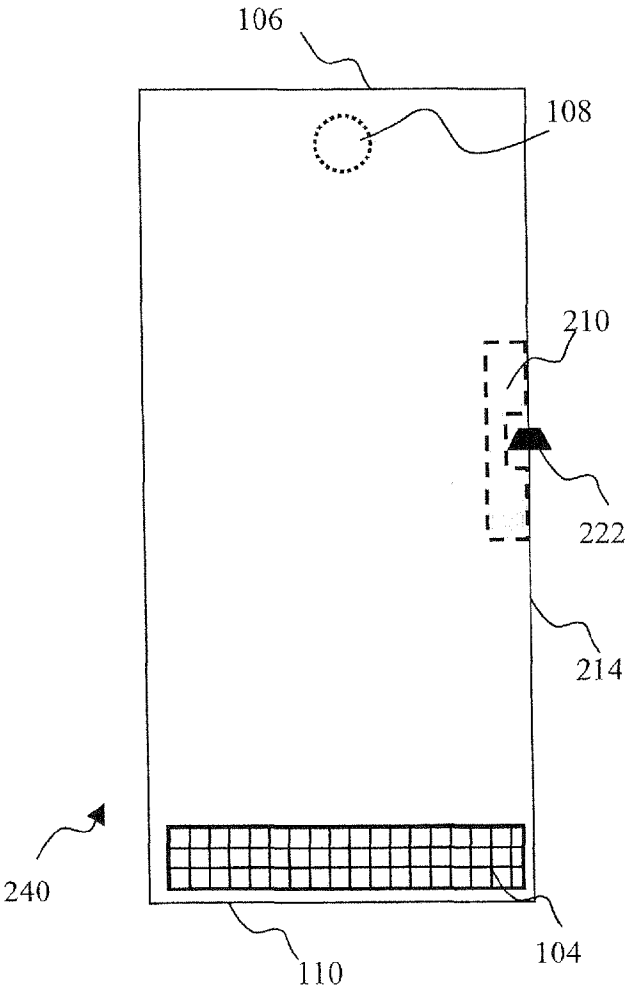
FIG. 2C is a top view depicting a second embodiment of an antenna loop resonator structure configuration, comprising a discrete capacitor.

Referring now to FIG. 2C, one embodiment of a mobile radio device PWB 240 is shown in detail. The back side 240 of the PWB is shown in FIG. 2C, and the loop resonator element further comprises a discrete capacitor 222.

Figure 2D:
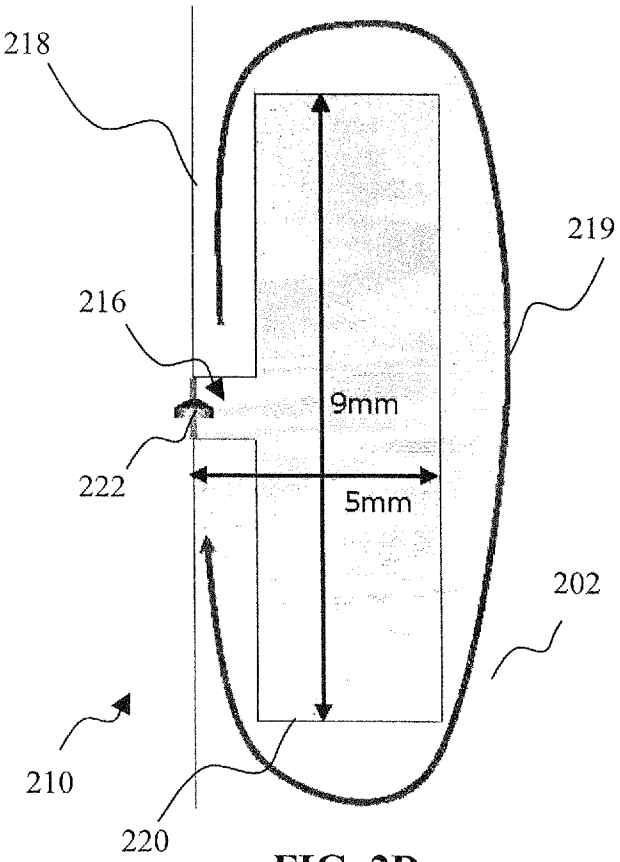
FIG. 2D is top view depicting a section of the antenna configuration of FIG. 2A showing the detailed structure of loop resonator, comprising a discrete capacitor in accordance with one embodiment of the present invention.

Referring now to FIG. 2D, an alternative resonant loop embodiment is shown in detail. In this embodiment, the resonator loop 210 further comprises a discrete capacitor electrically coupled to the ground plane conductive coating 202 across two sides (e.g. two opposing or two adjacent sides) of the opening 216. As in the embodiment presented above at FIG. 2B, the loop 210 shown in FIG. 2D is made on the PWB ground plane 202 as an etched pattern, while the capacitance for resonating the loop is provided via the dielectric block 222 which has a slot to separate the block ends, and to generate the capacitance. This approach advantageously makes it easier to adjust the capacitance for a desired application, and to obtain more accurate capacitance values for precise resonance tuning.

As yet another alternative, the resonant loop structure 210 can be formed as a separate element (not shown) with an integrated capacitor and attached to PWB via dedicated additional contact points. This separate element can be oriented parallel, normal or at an angle to the plane of PWB, while being parallel to the antenna main dipole-like axis, as required by a specific application It is also appreciated that while a single capacitor is shown in the present embodiment, multiple (i.e., two or more) components arranged in an electrically equivalent configuration may be used consistent with the present invention. Moreover, various types of capacitors may be used, such as discrete (e.g., plastic film, mica, glass, or paper) capacitors, or chip capacitors. Myriad other capacitor configurations useful with the present invention exist, as will be recognized by those of ordinary skill.

It is also recognized that the loop resonator structure according to the present invention can be used with a wide variety of configurations, including all quarter-wave antenna types (e.g. PIFA, monopole, etc.) that utilize the ground plane as a part of the radiating structure.

Exemplary embodiments of the antenna of the present invention utilize an LC (inductive-capacitive) resonating circuit. LC resonating circuits are well known in the electrical arts. Specifically, if a charged capacitor is connected across an inductor, electric charge will start to flow through the inductor, generating a magnetic field around it, and reducing the voltage across the capacitor. Eventually, the electric charge of the capacitor will be dissipated. However, the current will continue to flow through the inductor because inductors tend to resist rapid current changes, and energy will be extracted from the magnetic field to keep the current flowing. The current will begin to charge the capacitor with a voltage of opposite polarity to its original charge therefore depleting the magnetic field of the inductor. When the magnetic field is completely dissipated, the current will cease, and the electric charge will again be stored in the capacitor (with the opposite polarity). Then the discharge cycle will begin again, with the current flowing in the opposite direction through the inductor.

As the electric charge flows back and forth between the plates of the capacitor, through the inductor the energy oscillates back and forth between the capacitor and the inductor until (if not replenished by power from an external circuit) internal resistance of the electric circuit dissipates all of the electrical energy into heat. This action is known mathematically as a harmonic oscillator.

The resonance occurs when inductive and capacitive reactance values are equal in absolute value. That is:

$$X_L=\omega L=X_C=1/\omega C \tag{1}$$

where L is the inductance in henries, and C is the capacitance in farads, and w is the circular frequency in rad/s. Therefore the resonant frequency of the LC circuit is:

$$\omega=\sqrt{\frac{1}{LC}} \tag{2}$$

The loop 210 forms an LC resonator structure, where the capacitance is determined by the loop perimeter, and the inductance is determined by the size and configuration the PWB opening 216. Typically, a 1 pF capacitance is sufficient to generate loop resonance. A ceramic capacitive block 222 is used to achieve more accurate capacitive tuning of the resonator structure 210 if necessary.

Placement of the loop resonant structure 210 onto PWB 200 alters the electromagnetic field distribution across the PWB ground plane. By using loop resonators on the PWB edges, the PWB electrical length is modified so that PWB has a field maximum at a location closer to antenna, and a second maximum at the top end of the PWB (resonator loops create a high impedance point at the PWB).

Figure 1B:
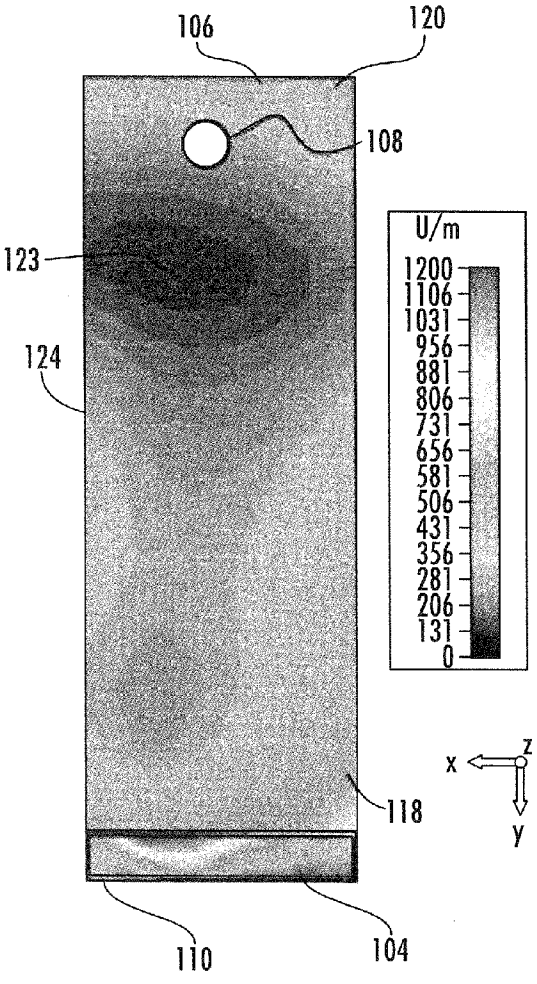
FIG. 1B is a graphical illustration of electric field (E-field) simulations for the device of FIG. 1A.
Figure 3A:
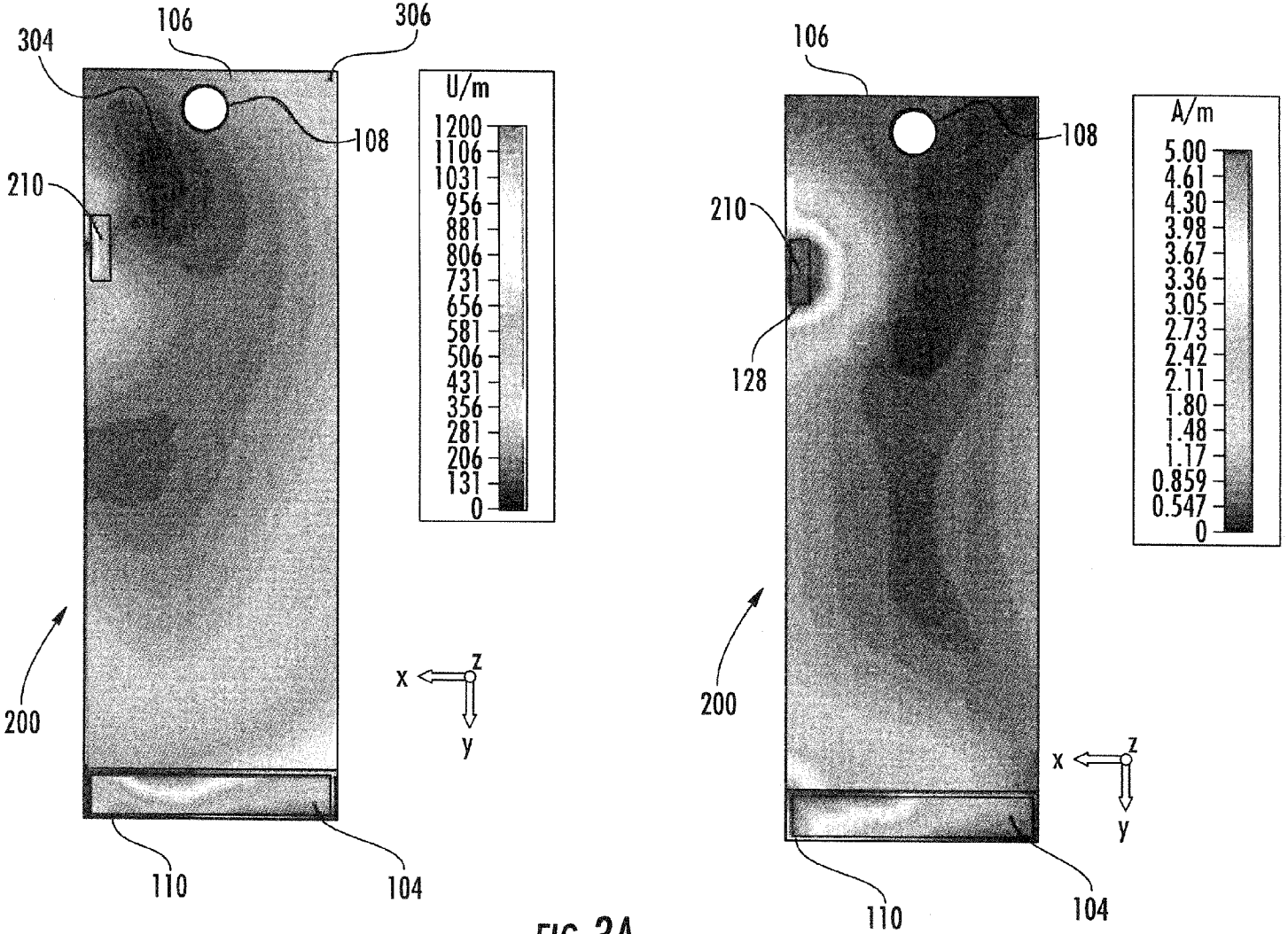
FIG. 3A is a graphical illustration of electric E-field and magnetic intensity (H-field) simulations for the antenna of FIG. 2A comprising a loop resonator structure disposed proximate to the H-field maximum (E-field minimum).

Referring now to FIG. 3A, simulated electric (E) and magnetic (H) field distribution across the PWB ground plane are presented for a PWB 200 with the loop resonator structure 210 located proximate to the magnetic field maximum 128. The location of the H-field maximum is computed using simulation results obtained with a bare PWB 100 and described above in FIG. 1B. The PWB electric field distribution generated by a uniform PWB ground plane (reference case) shown in FIG. 1B is similar to a half-wave dipole distribution with E-field maxima located at both ends of the ground plane.

Simulations performed by the Assignee hereof presented in FIG. 3A correspond to an air-filled opening or gap on the ground plane, and loop dimensions described in FIG. 2B. Comparing the E-field distributions of FIG. 3A and FIG. 1B, a noticeable shift in the E-field is observed: the local minimum 304 is moved closer to the top edge 106 of the PWB. Additionally, as a result of placing the loop resonator structure onto the PWB, areas with higher levels of electric field are moved close to the top corner 306 and away from the location of the interference-sensitive component (e.g., earpiece 108).

Figure 3B:
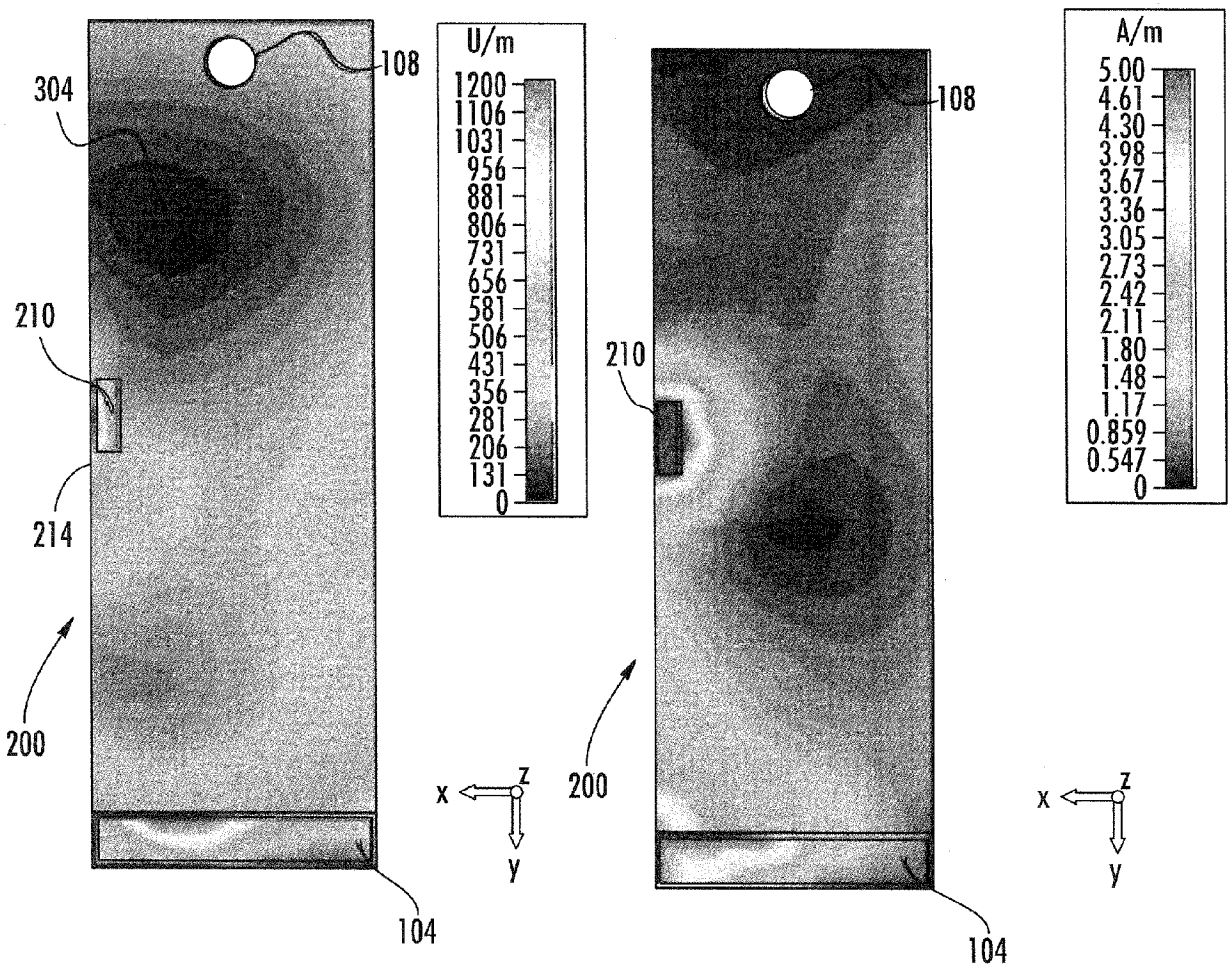
FIG. 3B is a graphical illustration of electric E-field and H-field simulations for the antenna of FIG. 2A comprising a loop resonator structure disposed proximate to a PWB central point.

Referring now to FIG. 3B, simulated electric (E) and magnetic (H) field distribution across the PWB ground plane are presented for the PWB 200 with the loop resonator structure located proximate to center point of the PWB long side 214. Simulations performed by the Assignee hereof and presented in FIG. 3B correspond to an air-filled opening or gap on the ground plane, and loop dimensions described in FIG. 2B. Comparing the E-field distributions of FIG. 3B and FIG. 3A, the E-field shift is less pronounced in the FIG. 3B configuration, and the E-field null (minimum) 304 is located farther away from the earpiece 108 as when compared to the data displayed in FIG. 3A.

Figure 4A:
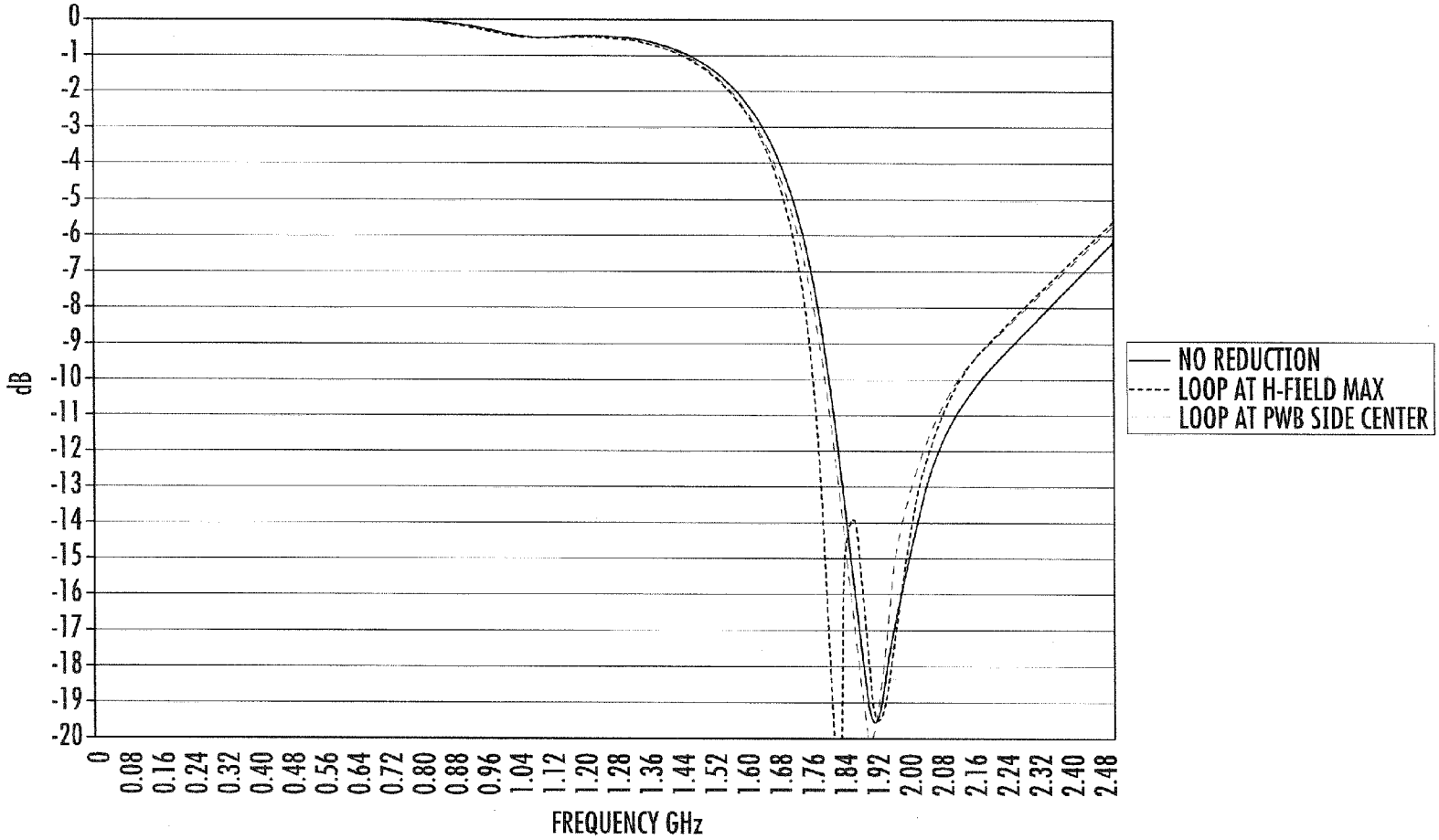
FIG. 4A is a plot of simulated free space input return loss for exemplary antenna configurations according to the present invention: including (i) a loop resonator structure disposed proximate to the H-field maximum; (ii) a loop resonator structure disposed proximate to the PWB center point; and (iii) a base PWB configuration without loop resonators.

Although the HAC improvement provided by the embodiment described in FIG. 3B is less when compared to the embodiment depicted in FIG. 3A, the embodiment of FIG. 3B significantly simplifies placement of the loop resonators. While the embodiment of FIG. 3A requires simulation of H-field prior to selecting the placement location for loop resonators, an antenna mid-point location is easily obtained thus making the configuration of FIG. 3B an attractive alternative for lower cost implementations. Referring now to FIG. 4A, a plot of simulated free space input return loss in decibel (dB) as a function of frequency (in GHz) for the exemplary antenna configurations of the present invention is shown. The antenna configurations include: (i) a loop resonator structure disposed proximate to the H-field maximum (ii) a loop resonator structure disposed proximate to PWB side at center point; and (iii) a base PWB configuration without loop resonators. Analyzing FIG. 4A, a second resonance is observed proximate to about 1.88 GHz frequency (center point of the PCS-1900 transmit band) for the PWB configuration comprising the resonant loop located at the H-field maximum.

Figure 4B:
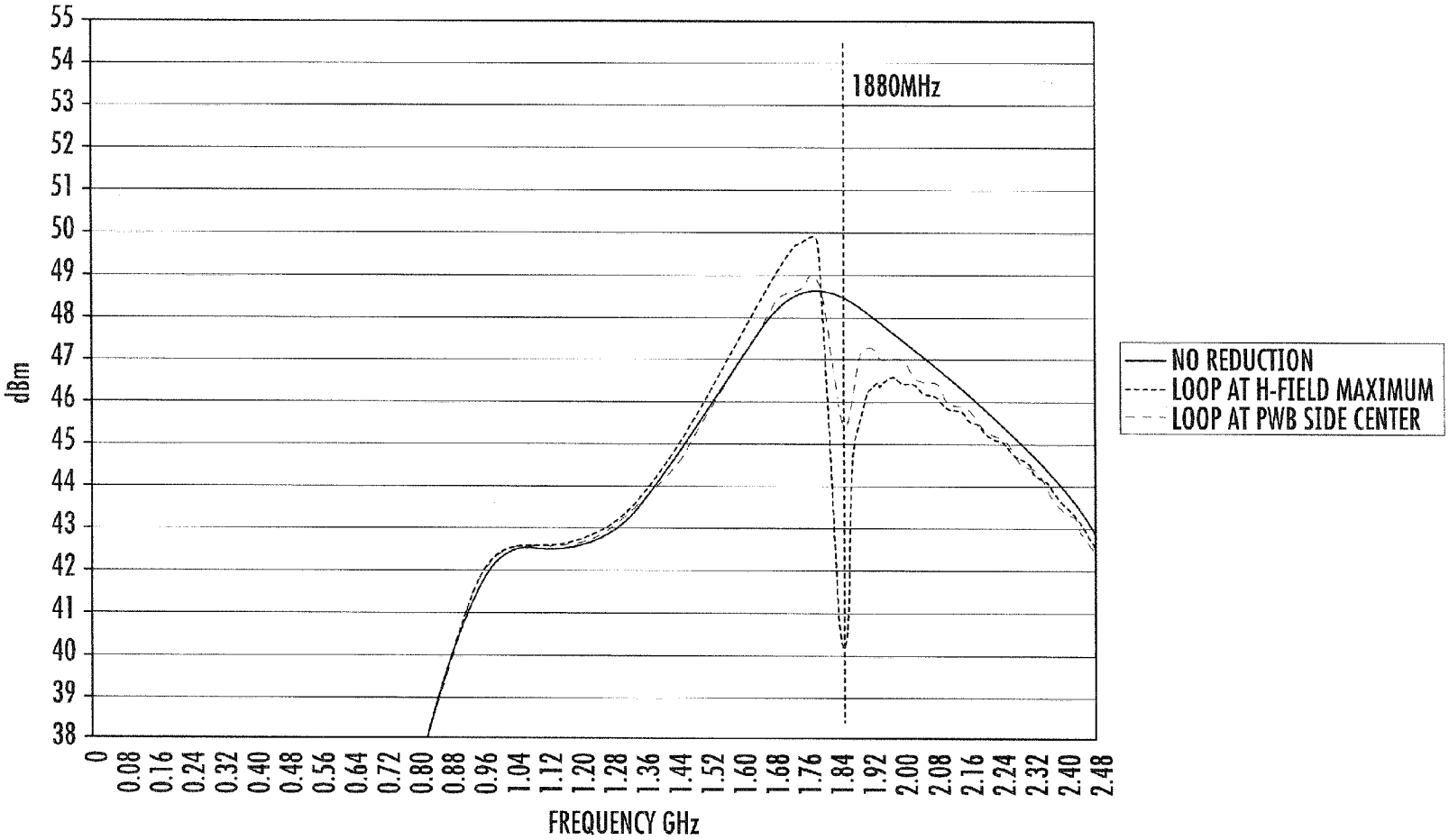
FIG. 4B is a plot of simulated broadband E-field at the earpiece location for different antenna configurations according to the invention, including: (i) a loop resonator structure disposed proximate to the H-field maximum; (ii) a loop resonator structure disposed proximate to PWB center point; and (iii) a base PWB configuration without loop resonators.

Referring now to FIG. 4B, a plot of simulated broadband electric field level in decibels (dB) computed at the earpiece location 206 as a function of frequency (in GHz) for the exemplary antenna configurations of the present invention is shown. The different curves shown in FIG. 4B correspond to the three different configurations discussed above with respect to FIG. 4A as follows: (i) a loop resonator structure disposed proximate to the H-field maximum; (ii) a loop resonator structure disposed proximate to PWB side at center point; and (iii) a base PWB configuration without loop resonators. Analyzing FIG. 4B, a substantial reduction of the electric field level is observed proximate to a frequency of approximately 1.88 GHz, for both of the resonant loop configurations. Comparing the E-field reduction produced by the two loop configurations shown in FIG. 4B to the simulation results obtained with the base PWB configuration (also shown on FIG. 4B), it is apparent that placing a resonant loop structure proximate to the H-field maximum produces a substantially larger reduction (of about 8 dB) in the simulated electric field as compared to loop placement at the PWB side center (about 3 dB, or about ½ of the power).

Figure 4C:
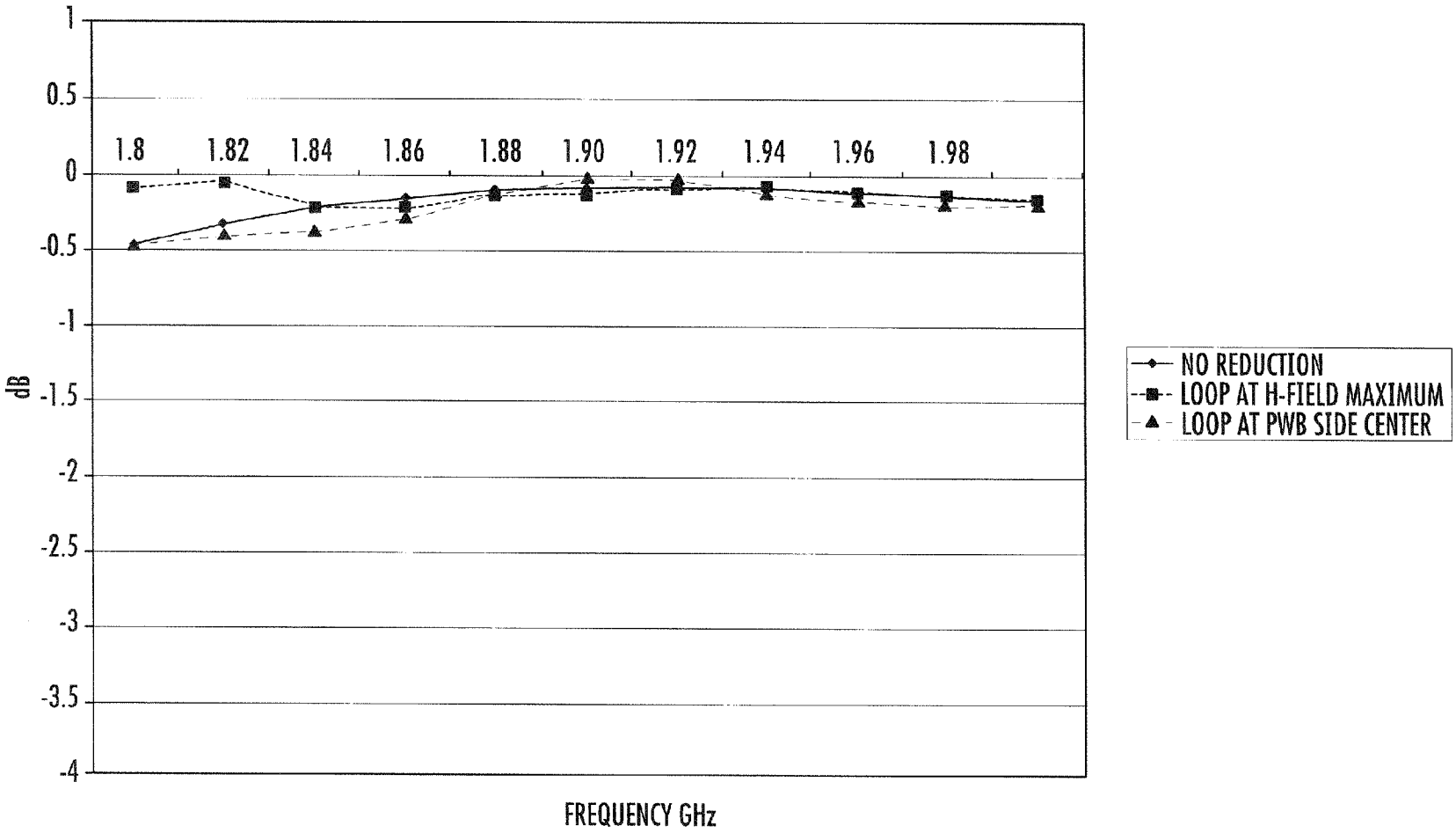
FIG. 4C is a free-space simulated efficiency plot for different antenna configurations according to the invention, including: (i) a loop resonator structure disposed proximate to the H-field maximum; (ii) a loop resonator structure disposed proximate to the PWB center point; and (iii) a base PWB configuration without loop resonators.

Referring now to FIG. 4C, a free-space simulated efficiency plot for different antenna configurations is shown, including: (i) a loop resonator structure disposed proximate to the H-field maximum; (ii) a loop resonator structure disposed proximate to PWB center point; and (iii) no loop resonator. Comparing the base PWB configuration with both resonant loop PWB configurations shown in FIG. 4C, it is apparent that the addition of one or more resonant loops to the PWB antenna structure does not reduce the overall antenna efficiency.

Figure 5A:
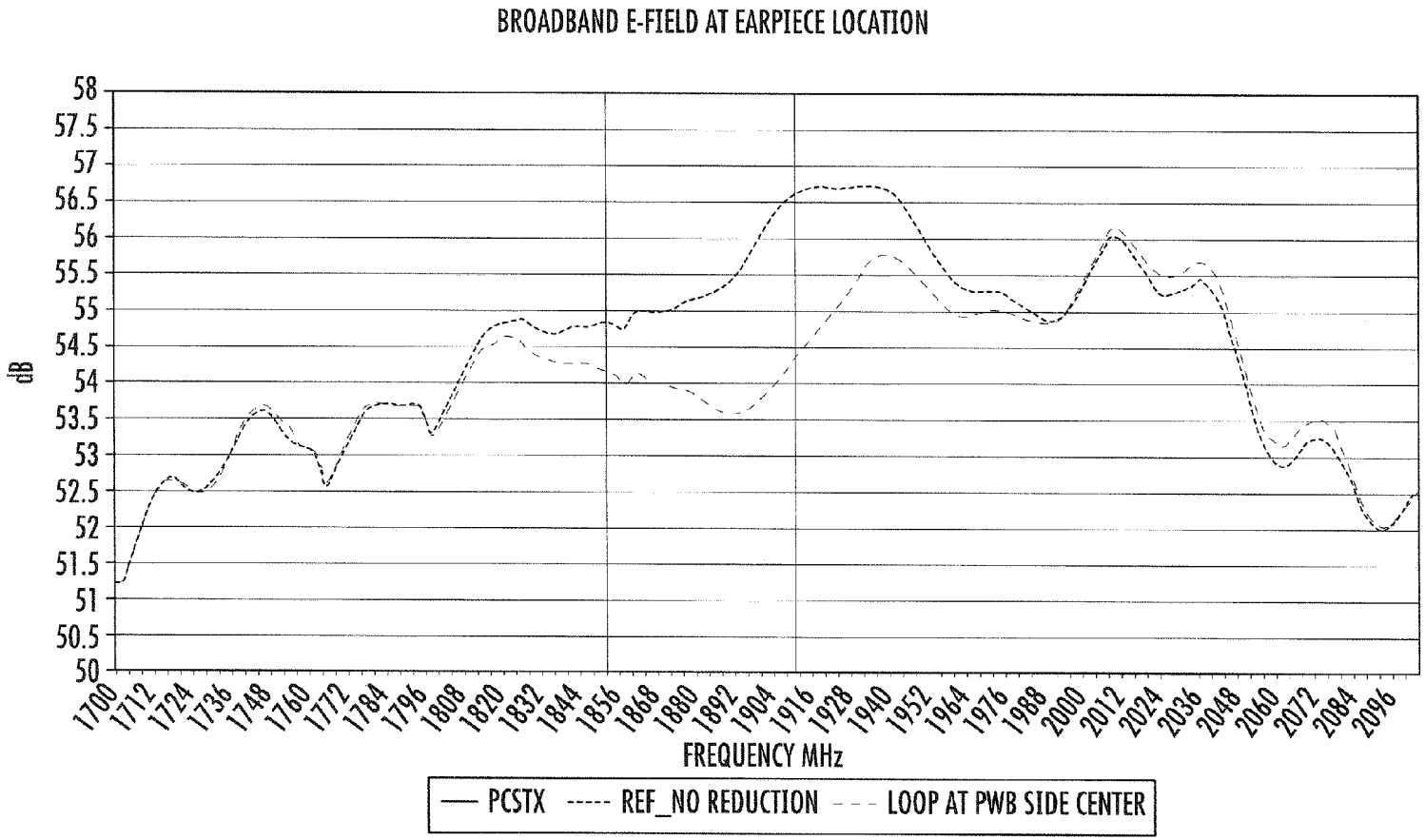
FIG. 5A is a plot of measured broadband E-field at the earpiece location for different antenna configurations according to the invention, including: (i) a loop resonator structure disposed proximate to PWB side at center point; and (ii) a base PWB configuration without loop resonators.
Figure 5B:
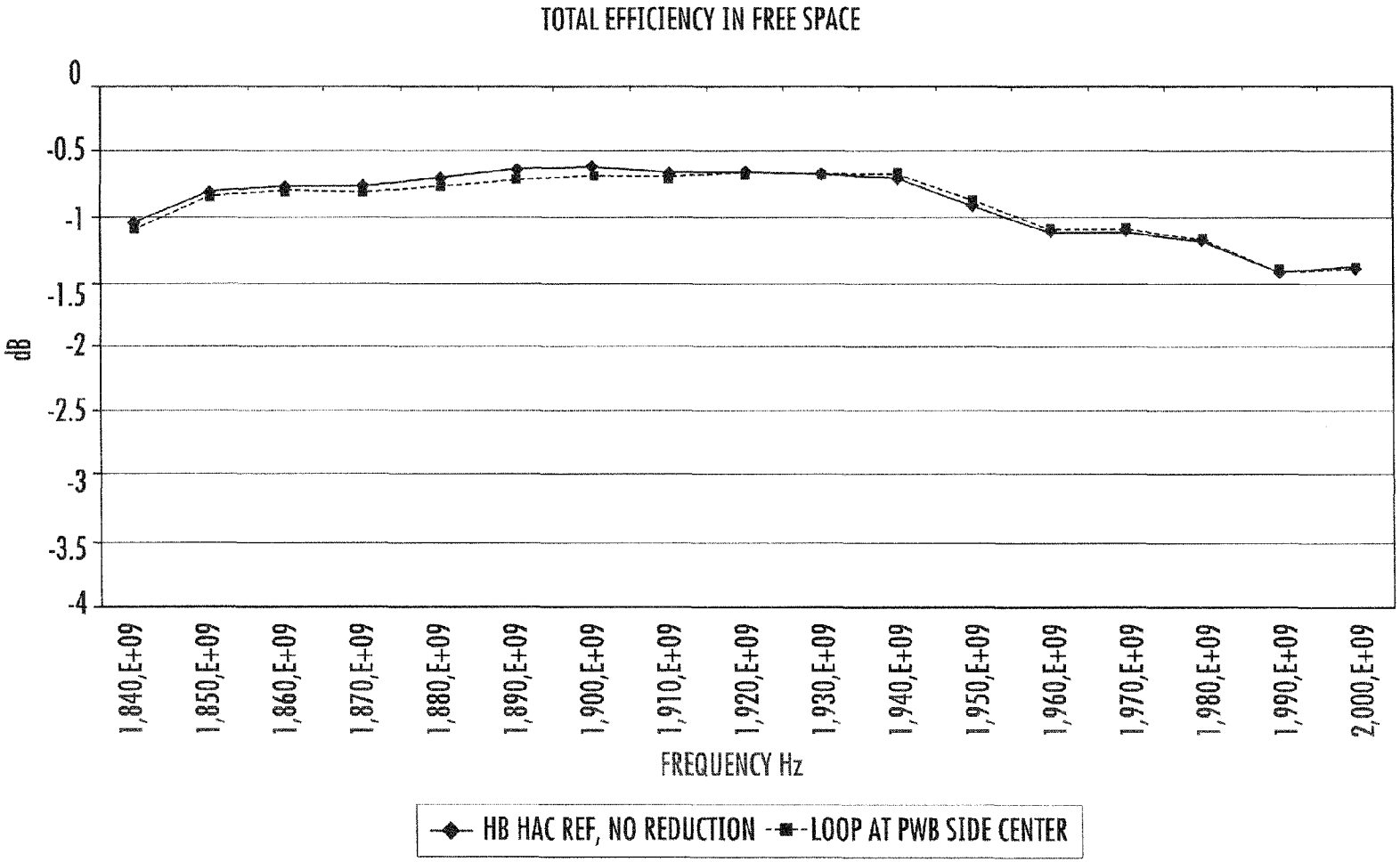
FIG. 5B is a free-space measured efficiency plot for different antenna configurations according to the invention, including: (i) a loop resonator structure disposed proximate to the PWB side at a central point; and (ii) a base PWB configuration without loop resonators.

FIGS. 5A-5C illustrate a series of measurements corresponding to the simulations results of FIG. 4A-FIG. 4C collected with a prototype PWB antenna apparatus constructed by the Assignee hereof, modified according with the principles of the present invention. FIG. 5A shows a plot of measured broadband E-field at the earpiece location for different antenna configurations, including: (i) a loop resonator structure disposed proximate to the PWB side at center point; and (ii) a base PWB configuration without loop resonators. The solid vertical lines of FIG. 5A denote the PCS transmit frequency band. Comparing E-field measurements for the two PWB configurations presented in FIG. 5A, an approximately 2-dB reduction of electrical radiated field at the earpiece location is advantageously produced within the PCS transmit band when a loop resonator structure is placed on the side center of the PWB ground plane according to the present invention. This corresponds to a 60% reduction in the radiated power levels.

FIG. 5B displays a free-space measured efficiency within a PCS transmit band (also referred to as the "high band") for different antenna configurations including: (i) a loop resonator structure disposed proximate to the PWB side at center point; and (ii) a base PWB configuration without loop resonators. The results of FIG. 5B are consistent with the data presented above in FIG. 4C, and confirm that the addition of resonant loops to the PWB antenna structure does not reduce the overall antenna efficiency. Moreover, high band efficiency is not affected since the PWB length is still sufficient to support the antenna resonant mode. By placing the loop at H-field maximum location, the effective PWB length resonates at the high-band, and therefore improves high-band bandwidth.

Alternative Exemplary Embodiment

Figure 6B:
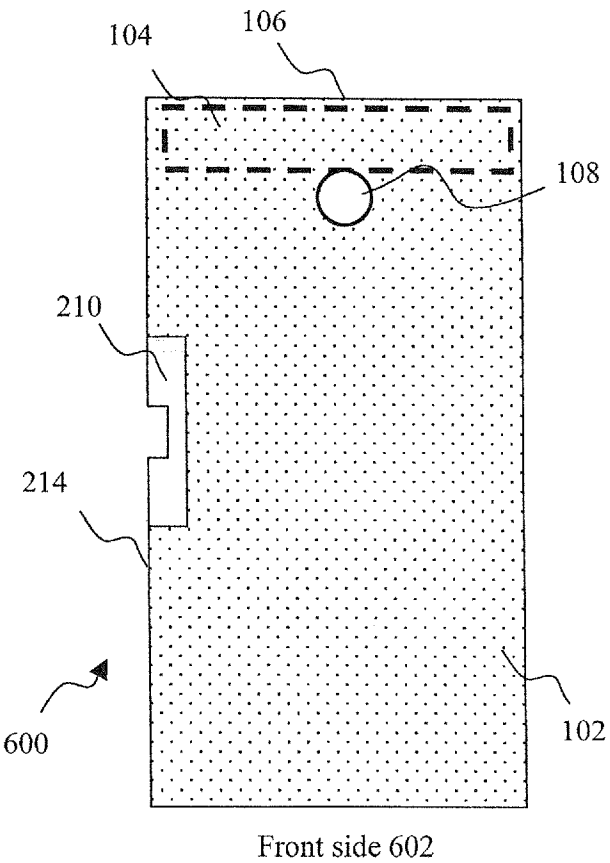
FIG. 6B is a top plan view illustrating the front side PWB configuration of FIG. 6A, with a loop resonator structure disposed proximate to the PWB side at center point.
Figure 6A:
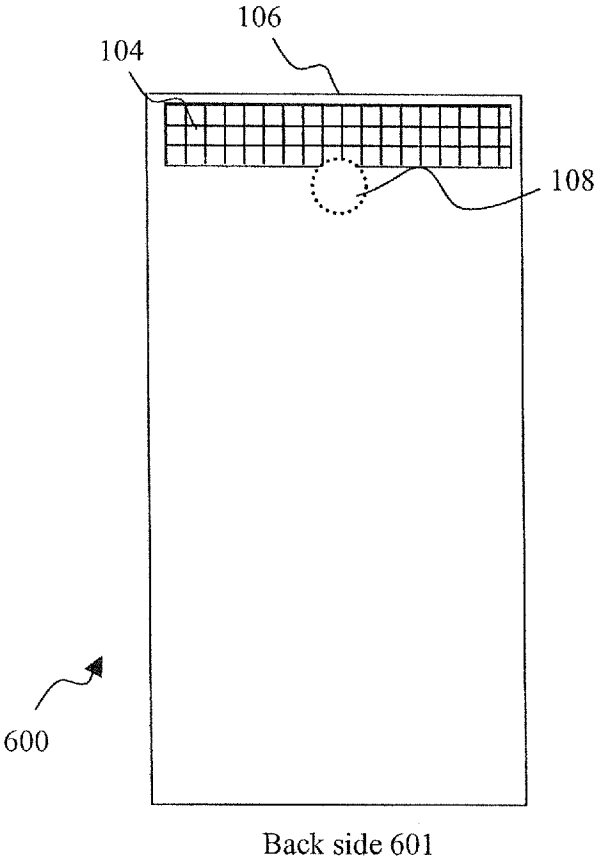
FIG. 6A is a top plan view illustrating the back side of an exemplary embodiment of a mobile device PWB configuration according to the invention, with an on-ground antenna disposed proximate the top side of the PWB.

FIG. 6A and FIG. 6B illustrate an exemplary embodiment of a mobile device PWB 600 configuration wherein an on-ground high-band antenna 104 is disposed proximate the top side 106 of the PWB. FIG. 6A is a top plan view of the PWB back side 601 showing the antenna 104 and earpiece 108 disposed on the planar side of the PWB 600 that is opposite from the ground plane 102 side. FIG. 6B shows the PWB front side 602, earpiece 108, and radiation reducing resonant loop structure 210 disposed on ground plane 102 along a vertical side 214 proximate to the PWB mid-point shown in FIG. 6A.

Figure 7A:
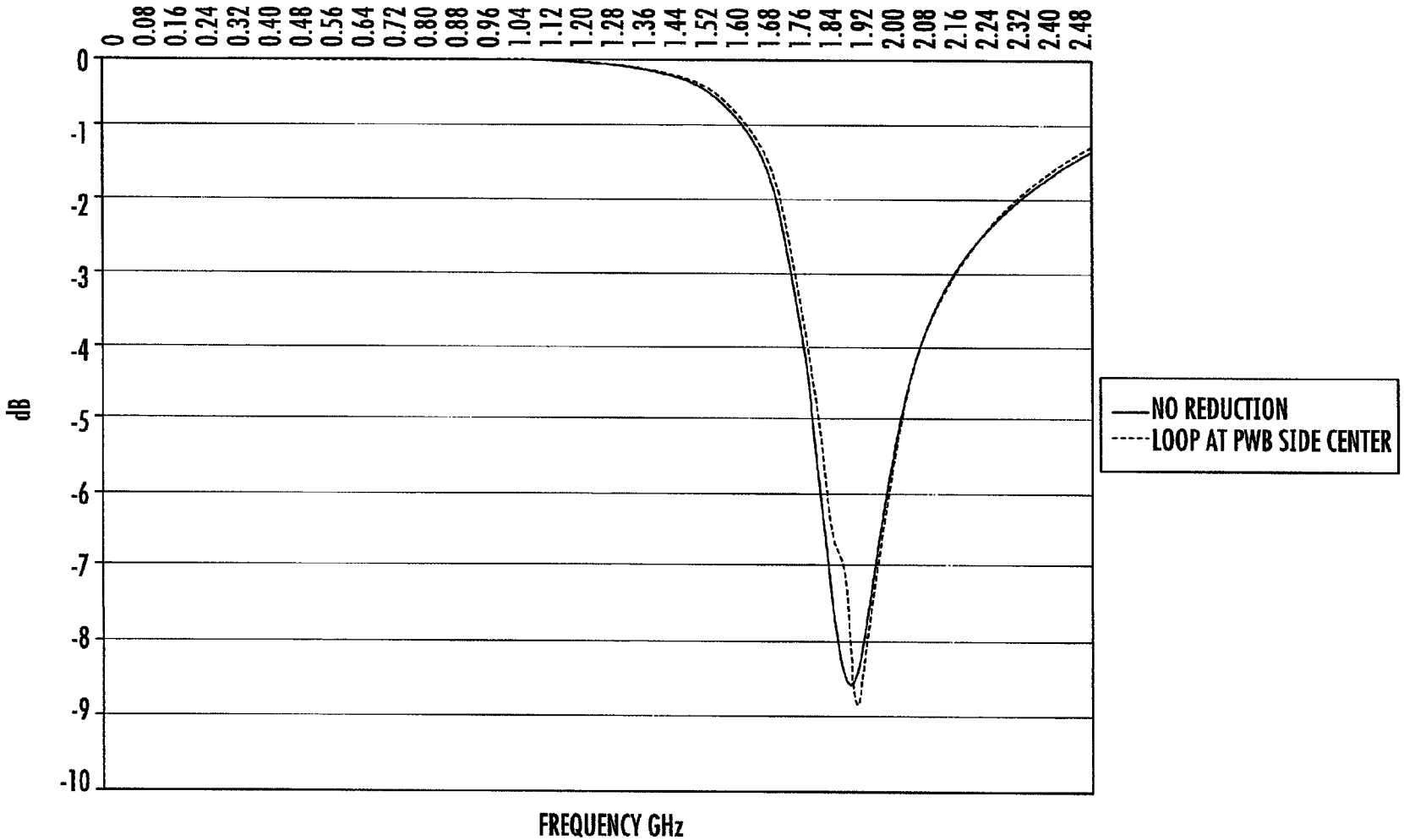
FIG. 7A is a plot of simulated free space input return loss for the exemplary antenna device of FIG. 6 for: (i) an antenna with the loop resonator structure disposed proximate to the PWB top side; and (ii) a base PWB configuration without loop resonators.
Figure 7B:
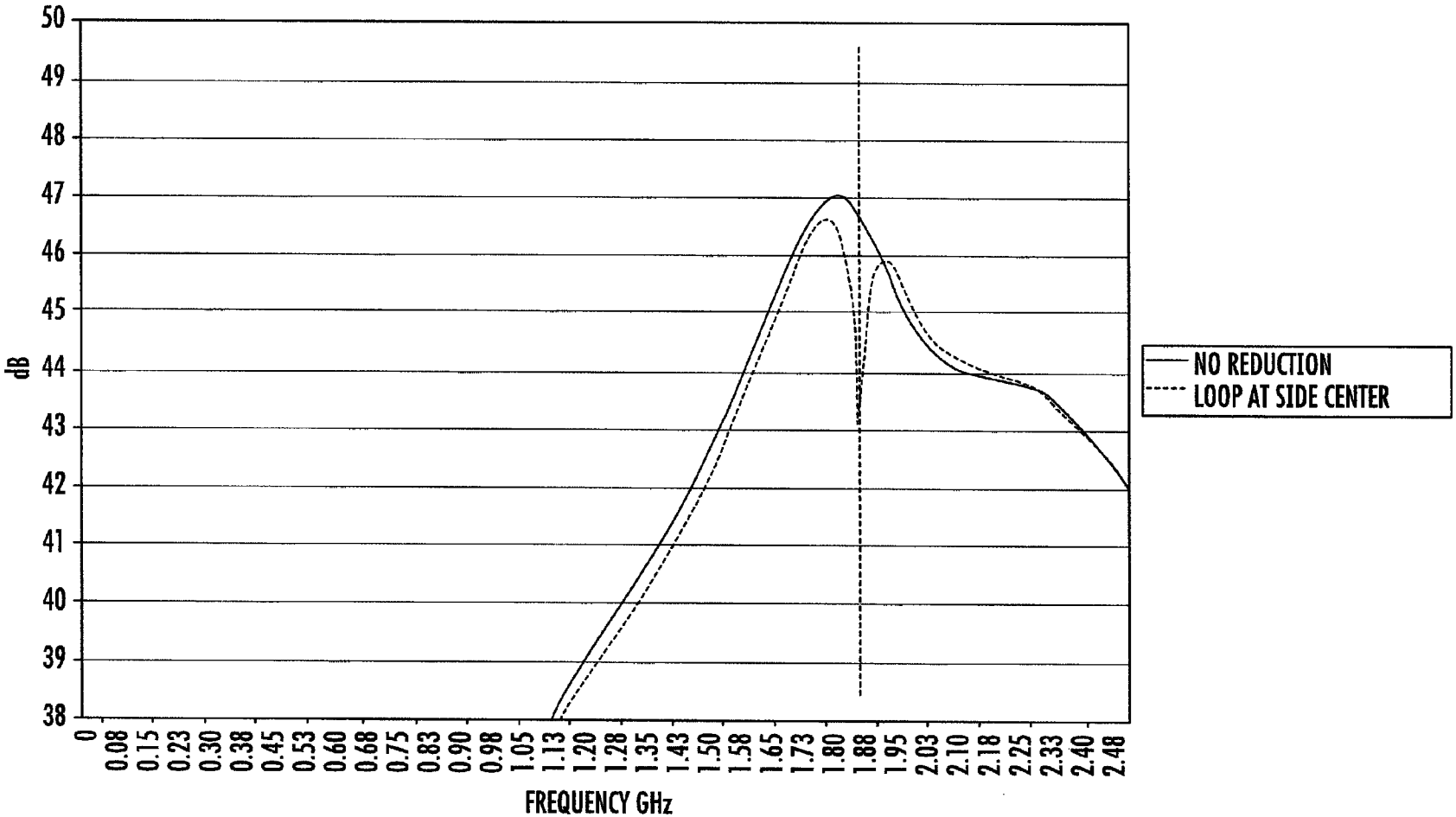
FIG. 7B is a plot of simulated broadband E-field at the interference-sensitive component (e.g., earpiece) location for the antenna according to FIG. 6, including: (i) an antenna with the loop resonator structure disposed proximate to the PWB top side; and (ii) a base PWB configuration without loop resonators.
Figure 7C:
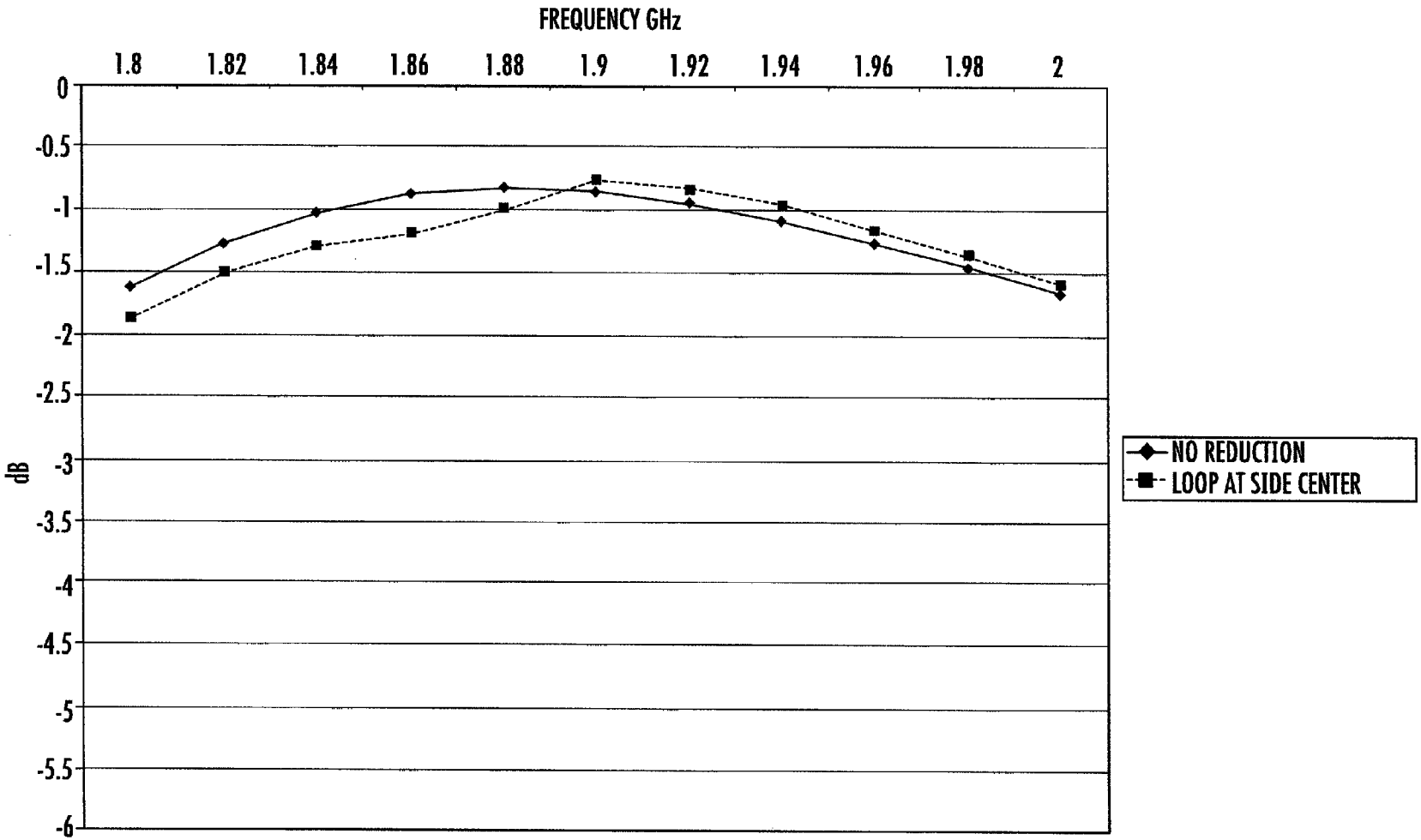
FIG. 7C a plot of simulated free space antenna efficiency PWB configuration of FIG. 6A for: (i) an antenna with the loop resonator structure disposed proximate to the PWB top side; and (ii) base PWB configuration without loop resonators.

Referring now to FIG. 7A-FIG. 7C, simulation results are presented for the antenna apparatus depicted in FIG. 6A and FIG. 6B. FIG. 7A is a plot of simulated free space input return loss in decibel (dB) as a function of frequency (in GHz). The corresponding base PWB configuration simulations (computed without the loop resonator) are also shown in FIG. 7A. Comparing the two results presented in FIG. 7A, a very close agreement between the two simulations results is observed.

FIG. 7B illustrates the simulated broadband electric field level in decibel (dB) computed at the earpiece location 610 as a function of frequency (in GHz. The different curves in FIG. 7B correspond to the three different configurations discussed above with respect to FIG. 7A as follows: (i) a loop resonator structure disposed proximate to PWB side at center point; and (ii) a base PWB configuration without loop resonators. Comparing the two results presented in FIG. 7B, a substantial reduction of the electric field level (of about 3.5 dB) is observed proximate to a frequency of about 1.88 GHz for the resonant loop configuration. It is apparent from the results shown in FIG. 7B that placing a resonant loop structure onto the PWB substantially reduces the electric field as compared to the loop base BWB configuration results.

Referring now to FIG. 7C, free-space simulated total efficiency plots for different antenna configurations discussed above with respect to FIG. 7B are shown. The different curves in FIG. 7C correspond to (i) a loop resonator structure disposed proximate to PWB side at center point; and (ii) a base PWB configuration without loop resonators. Comparing the base PWB configuration with the resonant loop PWB configuration shown in FIG. 7C, it is apparent that the addition of one or more resonant loops to the PWB antenna structure does not reduce the overall antenna efficiency. High band efficiency is advantageously not affected, since PWB length is still sufficient to support the requisite antenna resonant mode. By placing the loop at the H-field maximum location, the PWB length resonates at the high-band, and therefore improves high-band bandwidth.

Figure 8B:
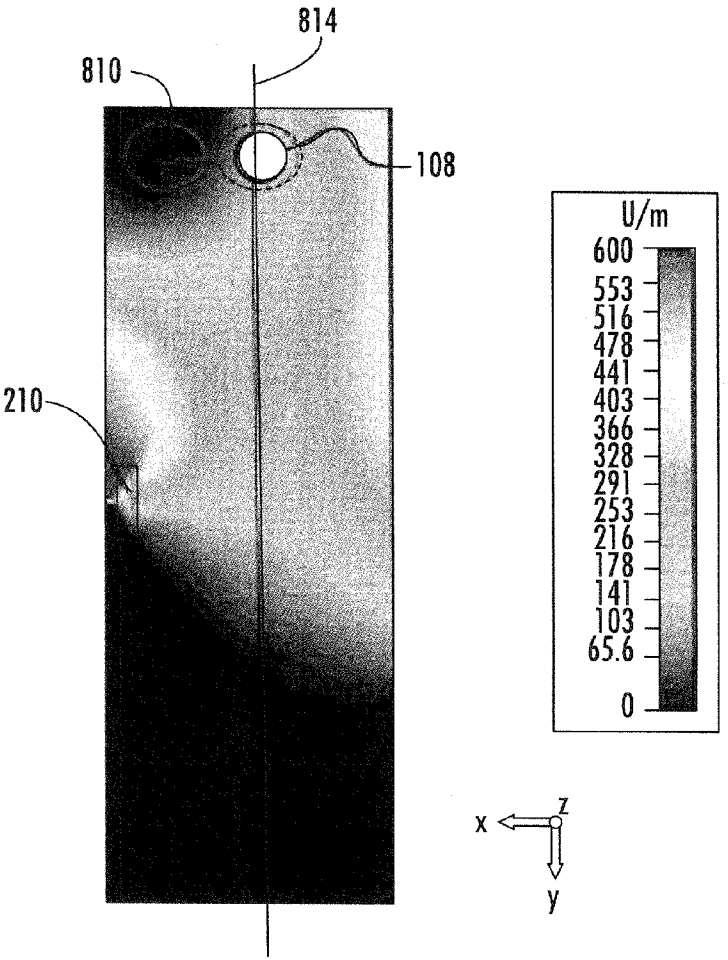
FIG. 8B illustrates simulated electric E-field alterations using a loop resonator structure in accordance with the principles of the present invention.
Figure 8A:
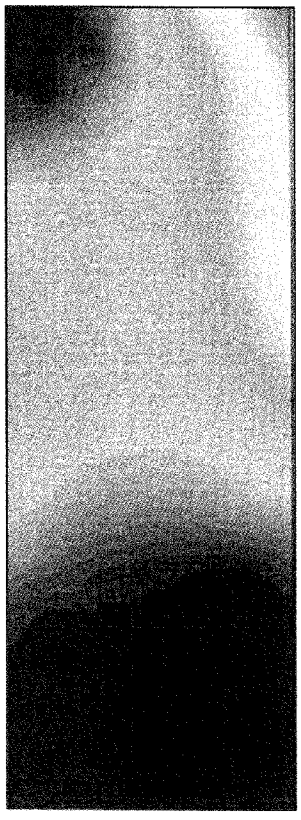
FIG. 8A displays electric E-field simulations for a reference PWB configuration of FIG. 6A with antenna elements disposed proximate to the earpiece.

FIG. 8A shows a simulated electric (E) field (V/m) distribution across the PWB ground plane of the PWB configuration of FIG. 6A discussed above, without the resonant loop structure. Comparing the E-field data shown in FIG. 8A (the antenna element 102 disposed proximate to the location of the earpiece 606) with the E-field data presented above in FIG. 3A (antenna element 103 disposed on the opposite end from the location of the earpiece 108), it is apparent that the electric field levels proximate the earpiece location 108 are higher (as shown in FIG. 8A) when the antenna element 104 is located proximate to the earpiece 108 as in the PWB configuration of FIG. 6A.

As discussed above with reference to FIG. 3A, employing a loop resonant structure with the PWB alters the electromagnetic field distribution across the PWB ground plane. FIG. 8B shows a simulated electric (E) field distribution across the PWB ground plane 102 for the PWB structure of FIG. 6B (with a loop resonator structure 210 located proximate center point of PWB 602 long side 214). Simulations performed by the Assignee hereof and presented in FIG. 813 corresponds to an air-filled opening or gap on the ground plane, and loop resonator dimensions as described in FIG. 2B. However, it would be readily appreciated by those skilled in the art when given the present disclosure that alternate resonant loop configurations may be used consistent with the present invention such as, inter alia, the examples presented in FIG. 2C and FIG. 2D, or variations thereof.

Comparing the E-field distributions of FIG. 8B and FIG. 8A, the shifts of local maxima and minima are less pronounced than in the data presented above in FIG. 3A. The null area 810 is noticeably asymmetric, and located closer to the left top corner area 812. Therefore when the antenna element and E-field point of interest (e.g., earpiece) are on same end of the PWB (with respect to the vertical dimension of FIG. 6A), a single loop resonator may not be sufficient to modify the electric field distribution enough to reduce the electric field level in the proximity of the earpiece.

For the antenna element placement depicted in FIG. 6B, additional loop resonator(s) are required to make electric field distribution fields more symmetric, and to shift the "null" area towards the center axis 814 of the PWB. A pair of resonators placed on the opposing vertical sides of the PWB ground plane brings the null center 810 closer to the PWB vertical center axis 814, and consequently closer to the earpiece 108 location. It will be appreciated, however, that other combinations of resonators (and their locations) may be used consistent with the invention in order to dispose the null at the desired location, and/or create multiple smaller relative nulls at two or more locations on the PCB.

Figure 9A:
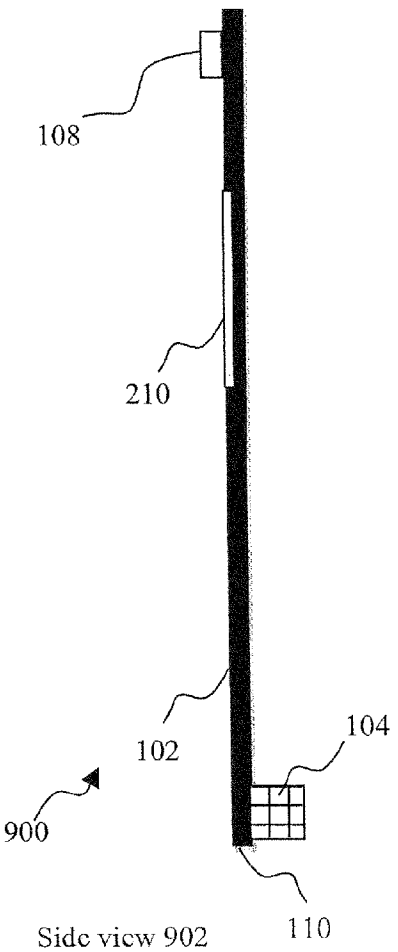
FIG. 9A illustrates an exemplary embodiment of a mobile device PWB configuration with an on-ground high-band antenna disposed on an opposite PWB end from the earpiece, and a pair of loop resonators disposed proximate to H-field local maxima, in accordance with the principles of the present invention.
Figure 9A:
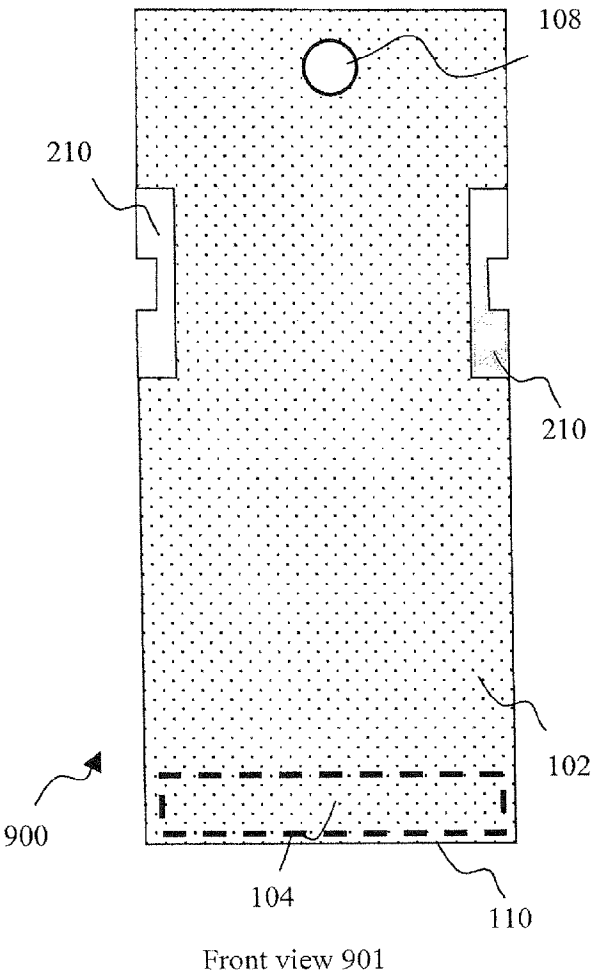
Figure 9B:
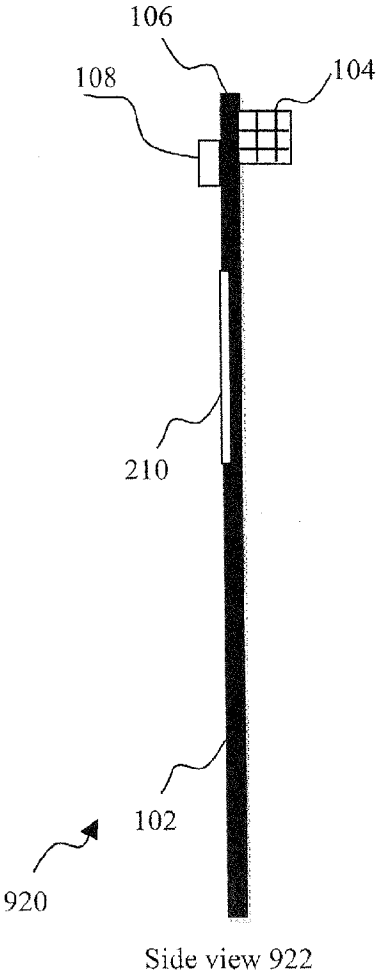
FIG. 9B illustrates an exemplary embodiment of a mobile device PWB configuration with an on-ground high-band antenna disposed proximate the earpiece, and a pair of loop resonators disposed proximate to H-field local maxima, in accordance with the principles of the present invention.
Figure 9B:
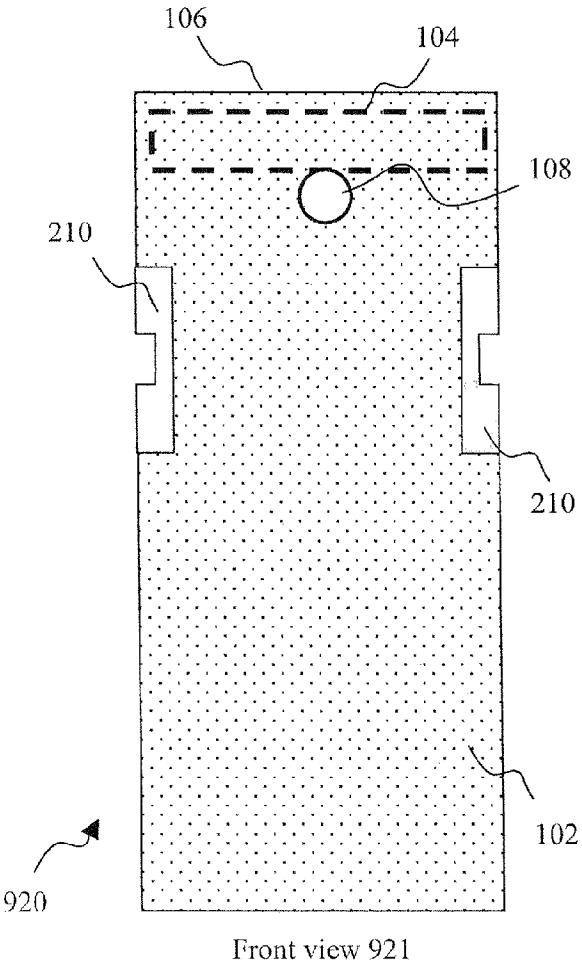

Referring now to FIGS. 9A-9B, PWB configurations comprising a plurality of loop resonator structures are illustrated. The PWB 900 of FIG. 9A comprises a substantially rectangular substrate element with a conductive coating deposited on the top planar side of the substrate to form a ground plane 102. An antenna element 104 is placed proximate the PWB bottom edge 110 on the planar side that is opposite from the conductive coating side. An audio component (e.g., earpiece 108) is located proximate to the PWB top end on the same planar side as the ground plane coating. A plurality of loop resonator structures 210 are further disposed on the ground pane 102 along vertical side edges of the PWB 900. Although only two resonator structures are shown for clarity, additional loop resonators may be used as required and as discussed previously herein. Moreover, the location of the loop resonators 210 with respect to PWB 900 does not need to be symmetric as illustrated in FIG. 9A, and myriad alternative placement configurations are possible, as can be appreciated by those skilled in the art given the present disclosure. Each resonator structure 210 is formed according to the principles of the invention as illustrated above at FIG. 2B or FIG. 2D, although it is further appreciated that the resonator structures may be heterogeneous in nature; e.g., one of a first type, size, and/or configuration, and one of a second type, size and/or configuration.

In the exemplary embodiment described in FIG. 9A, the resonator structures 210 are placed proximate locations of H-field maxima 126, 128. The determination of the H-field maxima is performed using H-field simulations of a PWB without loop resonators, as discussed above in reference to FIG. 1C.

FIG. 9B describes an alternative PWB embodiment comprising a pair of loop resonators. The PWB 920 configuration of FIG. 9B is in many ways similar to the PWB configuration 900 described above. However, in this case, the antenna element 104 is placed proximate the PWB top edge 106 on the planar side that is opposite from the conductive coating side. This PWB configuration places the antenna element 104 proximate to the audio component 108, thus enabling reduction of the PWB lateral (longer) dimension.

In the exemplary embodiment described in FIG. 9B, the resonator structures 210 are placed proximate to the locations of H-field maxima 126, 128. The determination of the H-field maxima is performed using H-field simulations of a PWB without loop resonators, as discussed above in reference to FIG. 1C. Each resonator structure 210 is configured such as that illustrated above at FIG. 2B or FIG. 2D, although it is further appreciated that the resonator structures may be heterogeneous in nature; e.g., one of a first type, size, and/or configuration, and one of a second type, size and/or configuration.

Figure 10:
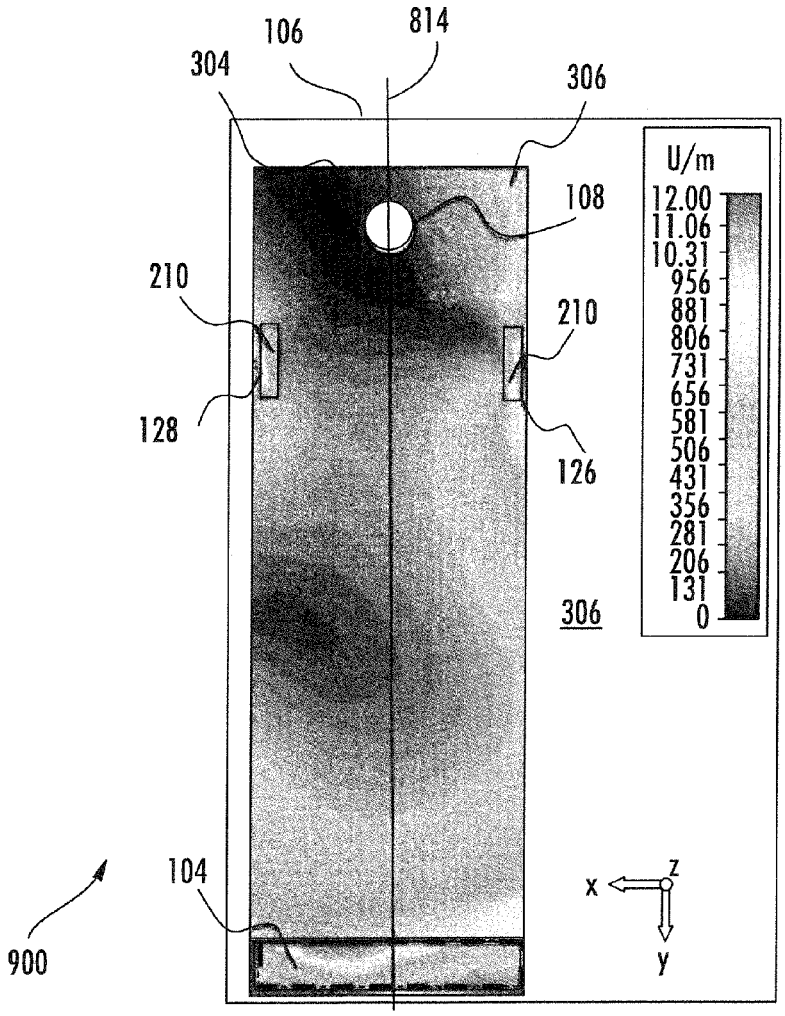
FIG. 10 presents electric E-field simulations for the PWB of FIG. 9, comprising a pair of loop resonators disposed proximate to H-field local maxima.

Referring now to FIG. 10, a simulated electric (E) field distribution across the ground plane is presented for the PWB configuration 900 of FIG. 9. The two loop resonators are 210 are disposed proximate to the magnetic field local maxima. The simulations presented in FIG. 10 correspond to an air-filled opening or gap on the ground plane, and loop dimensions as described in FIG. 2B. Comparing the E-field distributions of FIG. 10 and FIG. 3A, noticeable changes in the E-field distribution are observed: i.e., the local minimum (null) 304 is moved closer to the top edge 106 of the PWB. Additionally, as a result of placing an additional loop resonator structure onto the PWB, areas with higher levels of eclectic field 306 are moved closer to the right edge of the PWB 900, and away from the location of the earpiece 108. Further comparison with the simulation results obtained with a single resonator loop (presented above in FIG. 3B) show that the use of two resonator structures produces a more symmetric electric radiation pattern, with the local minimum located closer to the earpiece, as shown in FIG. 10. Loop resonators added on both edges of the PWB at E-field minimum (H-field maximum) locations provide the best coupling. Placing loop resonators at the PWB edges modifies the PWB electrical length so that electric field maxima are formed at a location closer to the antenna, and near the top edge (the resonator loops create a high impedance point) of the PWB.

When the antenna element and E-field point of interest (audio component) are on same end of the ground plane, use of loop resonators to modify the field distribution is not as effective, as in case where antenna is placed to the opposite end of the PWB. In this case, a second (or yet additional) resonator should be added so that the resonators are placed on both sides of the ground plane to bring the null to the center of the PWB x-axis.

It is also noted that in various implementations of the invention, several "points of interest" may exist (such as where two or more electrically sensitive components are disposed on the PWB at different locations). Specifically, various component/device configurations can be used to achieve acceptable results at each of the points of interest, versus perhaps optimizing the performance at one point of interest to the detriment of one or more other points of interest. Hence, the present invention contemplates a "holistic" tuning approach, wherein multiple points are considered simultaneously, and more modest improvements in field reduction at multiple such points are traded for a more significant reduction at one point, and lesser reductions at other points ("balanced" approach).

Antenna Tuning Method

A method of tuning antenna in a mobile radio device in accordance with an embodiment of the present invention is now described in detail. The method comprises using one or more loop resonators to shift the E-field local minimum as close to the earpiece location as possible. By changing the resonator(s) location along PWB edges relative to antenna element (the y-distance), the local E-field minimum is moved proximate to the earpiece location (where HAC is typically measured). Fine-tuning of the resonator location is further used to "set" the effective electrical length of the PWB to support high-band antenna operation, and increase antenna efficiency bandwidth in small antenna cases. As described above with respect to FIG. 10, one or more additional loop resonators enable making the E-field distribution more symmetric, and moving the E-field null(s) towards a (or respective) desired location(s).

Figure 11:
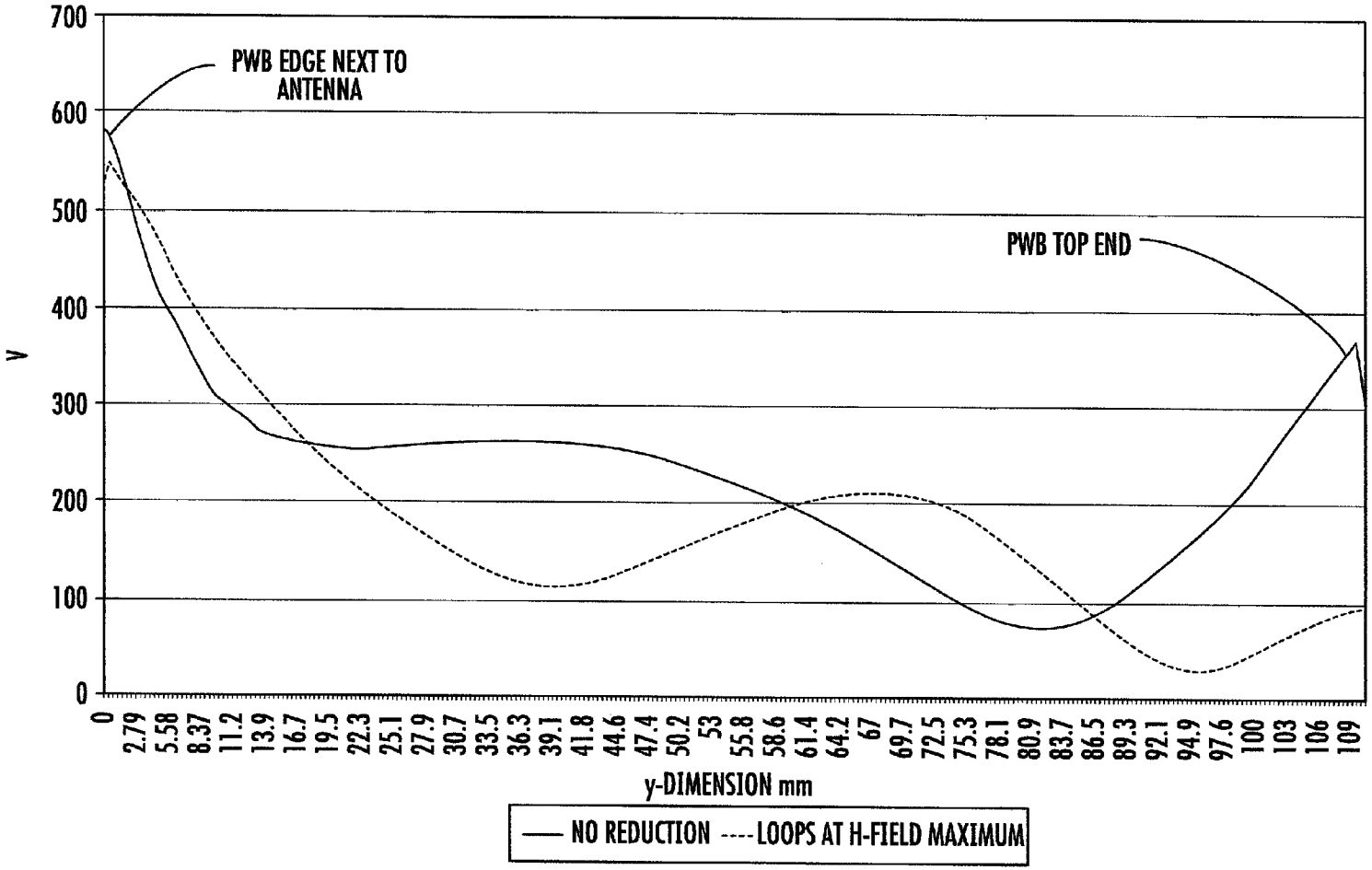
FIG. 11 depicts simulated axial E-field distribution for the PWB configuration of FIG. 10.

Referring now to FIG. 11, a simulated axial E-field distribution is shown along axis 814 (as described above with respect to FIG. 8B) with the antenna element 104 placed proximate the bottom edge of the PWB 900 and opposite from the earpiece location (FIG. 10). FIG. 11 shows the base PWB configuration without loop resonators, as well as data from simulations performed for the PWB configuration comprising a pair of loop resonators 210 as shown above in FIG. 9A.

Referring now to FIG. 11, a reference case with uniform PWB ground plane electric field distribution is shown, similar to a half-wave dipole distribution with an E-field maxima at the ground plane horizontal edges 106, 110. The loop resonators placed on the PWB vertical edges modify the electric field distribution so that the PWB has a field maximum at a location closer to the antenna 104, and a minimum proximate to the PWB top edge 106 (the resonator loops create a high impedance point to the PWB).

In addition to varying the location of loop resonator structures as described above, antenna tuning may be performed by varying the capacitance or inductance (or both) values of the LC resonator.

Low Band Antenna Tuning

Figure 12A:
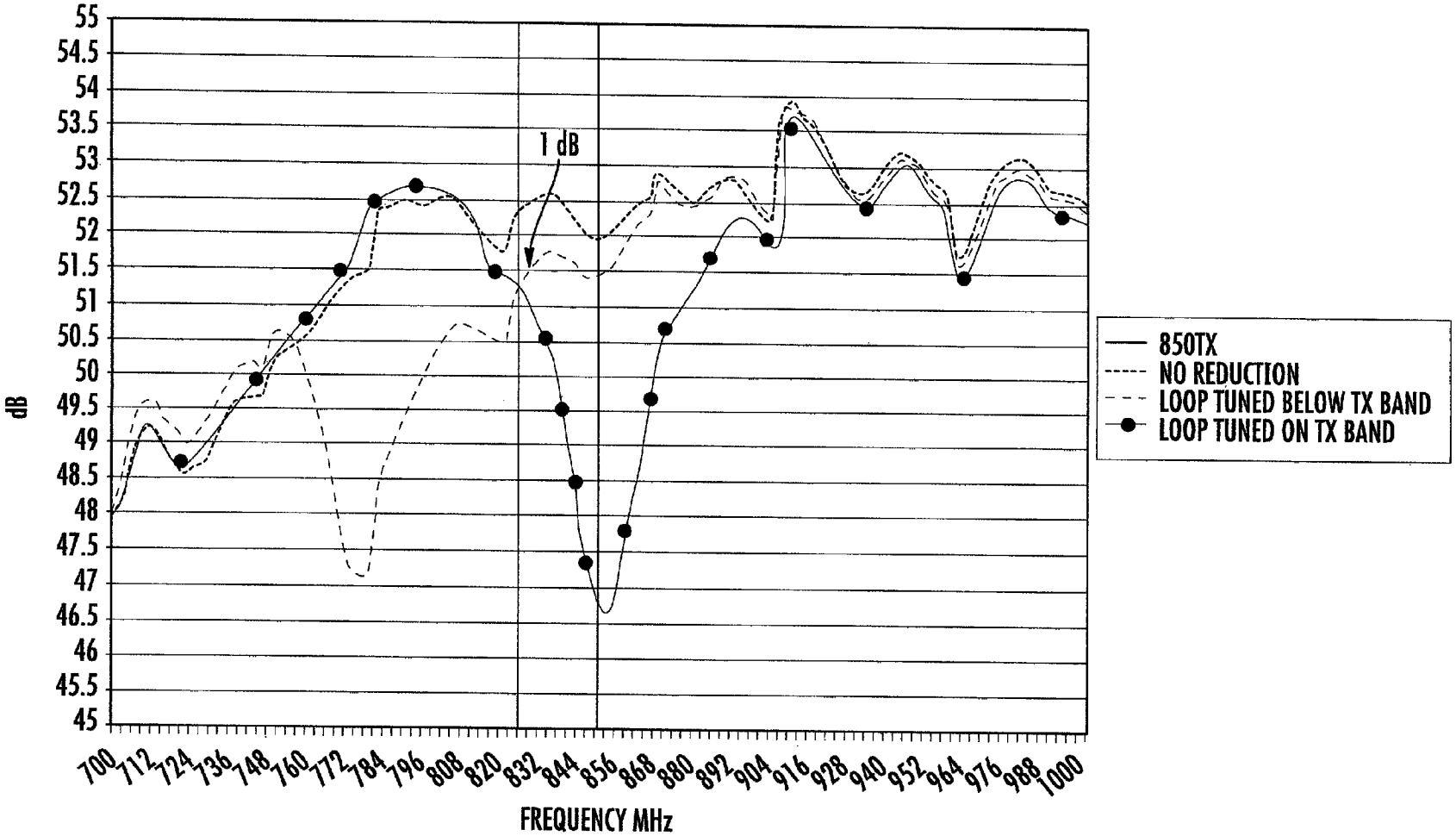
FIG. 12A is a plot of measured broadband E-field at the earpiece location for different loop tuning configurations including: (i) a loop resonator structure tuned to TX band; (ii) a loop resonator structure tuned to TX band; and (iii) a base PWB configuration without loop resonators.
Figure 12B:
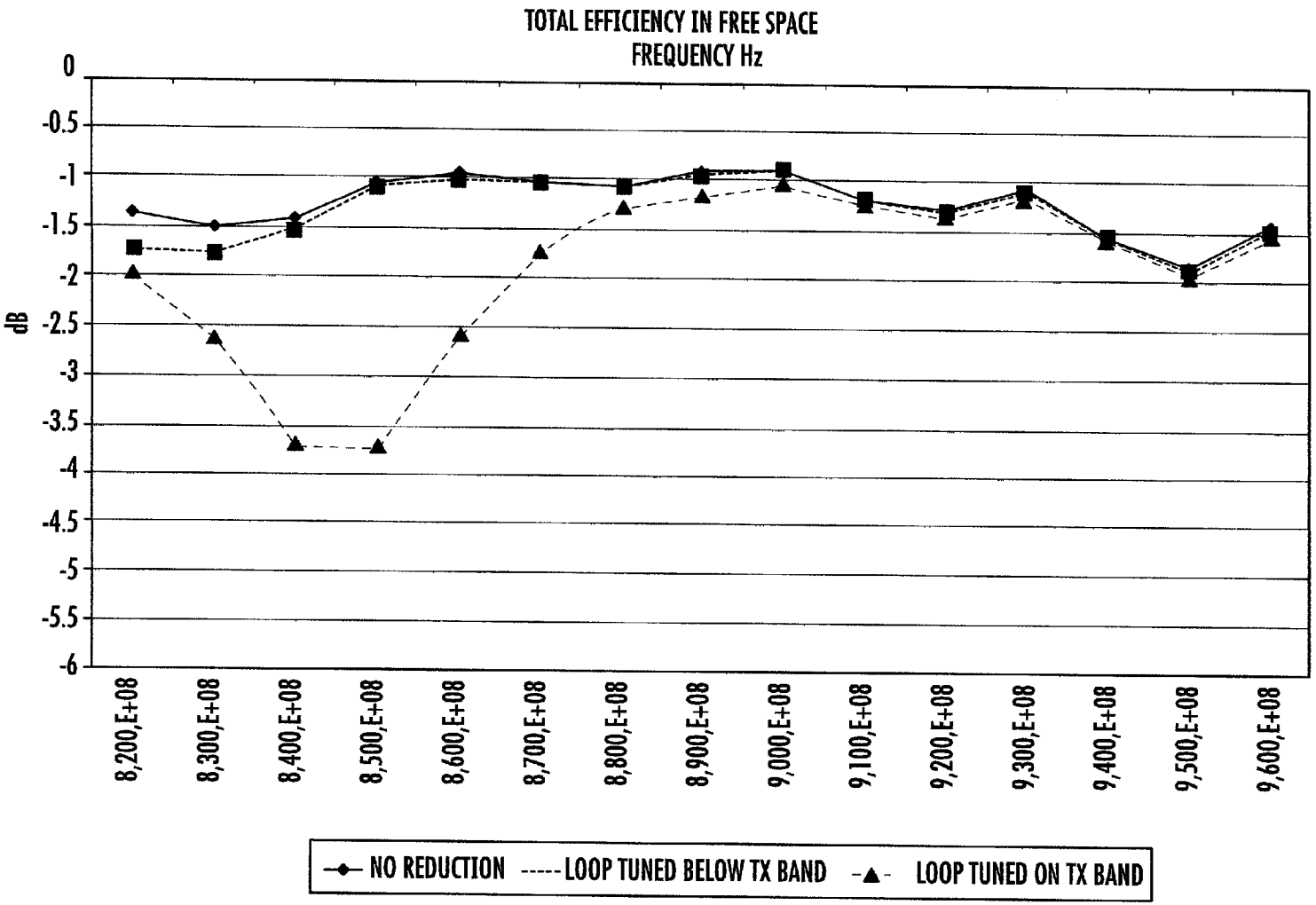
FIG. 12B is a free-space efficiency measured with two different antenna configurations including: (i) a loop resonator structure disposed proximate to a PWB side at center point; and (ii) a base PWB configuration without loop resonators.

Referring now to FIG. 12A and FIG. 12B, one embodiment of the method of antenna tuning using loop resonator structure(s) in accordance with the principles of the present invention is described and illustrated.

FIG. 12A shows the electric field strength in dB measured at the PWB earpiece location 108 for the following PWB configurations: (i) the base PWB configuration without loop resonator tuning; (ii) PWB with the resonator loop(s), placed proximate to the center point of the PWB long side 214, and tuned below the antenna transmit band of operation; and (iii) PWB with the resonant loop(s), placed proximate center point of the PWB long side 214, and tuned to the antenna band of operation. The vertical lines in FIG. 12A mark the boundaries of GSM-850 transmit (TX) frequency band, which is selected purely for purposes of illustration. Consistent with the Eqn. 1 tuning relationship, the capacitor value corresponding to the loop tuned on GSM-850 transmit band (shown in FIG. 12A) is smaller than the capacitance value used to tune resonant loop below GSM-850 TX band. By tuning the resonant loop below the antenna operating band, an approximately 1-dB reduction in the electric field strength is advantageously achieved at the earpiece location, thereby further improving hearing aid compliance.

FIG. 12B illustrates the measured total free-space antenna efficiency in dB over the GSM-850 TX frequency band for the following PWB configurations: (i) the base PWB configuration without loop resonator tuning; (ii) resonant loop(s) placed proximate to the center point of the PWB long side 214 and tuned below the antenna transmit band of operation; and (iii) resonant loop(s) placed proximate to the center point of the PWB long side 214 and tuned to the antenna band of operation. Reviewing the data presented in FIG. 12B, an approximately 2.5 dB decrease of antenna efficiency is observed in the TX frequency band when the antenna is tuned at the TX band (see FIG. 12B). Therefore, it is typically impractical to tune the resonant loop to operate in the GSM-850 TX band, since changing the PWB effective length also decreases antenna efficiency by about 2.5 dB. Instead, by tuning the resonant loop below the GSM-850 TX band, the efficiency loss is only about 0.5 dB (shown in FIG. 12B), while E-field strength is reduced by about 1 dB (also shown in FIG. 12A).

Hence, the HAC compliance methodology of the present embodiment is more effective when operating in the high band frequency range (e.g. 1800 MHZ or 1900 MHz) where antenna efficiency is typically less dependent on PWB length. However, benefits are none-the-less provided in lower frequency bands (albeit not quite as large as those in the higher bands).

PAN/WLAN/WMAN Variants

It will be appreciated that while the foregoing variants are described primarily in the context of a candy-bar, flip-type, or slide-to-open cellular telephone and one or more associated cellular (e.g., 3GPP, PCS, UMTS, GSM, LTE, etc.) air interfaces, the various methods and apparatus of the invention may be adapted to other types of applications and/or air interfaces. For example, many extant or incipient "smartphone" designs include multiple air interfaces, including WLAN, Bluetooth, and/or WiMAX interfaces as well as a cellular interface(s). For instance, a WLAN (e.g., Wi-Fi or IEEE Std. 802.11) interface typically operates at roughly 2.4 GHz, and can also create electric field interference with sensitive devices such as earpieces. Hence, the present invention explicitly recognizes that the techniques described supra may be applied to the antenna(s) associated with these auxiliary (e.g., PAN/WLAN/WMAN) interfaces, so as to mitigate or shift the field strength at the desired location(s). Moreover, the field created by the PAN/WLAN/WMAN interface may also be additive with that created by the cellular interface(s), such as where the cellular interface is being used simultaneously with the WLAN interface (e.g., the user is talking on the phone and also sending packetized data over the WLAN interface). Hence, the present invention further contemplates "complex" application, modeling and design scenarios, such that two or more interfaces are considered in the design and/or compensation process (e.g., loop resonators may be used on the antenna of both interfaces if separate, such that the additive fields from both antennas are mitigated sufficiently to produce HAC compliance or other desired objectives). For example, in one embodiment, several separate loop resonators are each tuned to the corresponding radio frequency band, and are located so as to achieve the best coupling to the PWB ground plane, and to accomplish the greatest electric field reduction at a point(s) of interest.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. An antenna for use in a mobile radio device, the antenna comprising:

a ground plane; and at least one resonator element disposed on said ground plane of said antenna, said at least one resonator element comprising at least a capacitance and an inductance and configured to form a resonance at a first frequency;

wherein said at least one resonator element is disposed on said ground plane at a selected first location proximate a location of maximum magnetic intensity so as to reduce electric field strength at a second location.

2. The antenna of claim 1, wherein said mobile radio device comprises an interference-sensitive component, and said second location is proximate to a location of said interference-sensitive component, said reduced electrical field strength thereby reducing interference of said antenna with said interference-sensitive component.

3. The antenna of claim 2, wherein said interference-sensitive component comprises an audio component.

4. The antenna of claim 2, wherein said interference-sensitive component comprises an electric coil component.

5. The antenna of claim 1, wherein said at least one resonator element comprises a loop-type shape having at least one gap formed therein.

6. The antenna of claim 5, wherein said at least one gap comprises a single gap formed proximate a longitudinal edge of a substrate onto which said ground plane is formed.

* * * * *